US006808855B2

(12) United States Patent
Ayaki et al.

(10) Patent No.: US 6,808,855 B2
(45) Date of Patent: Oct. 26, 2004

(54) PROCESS FOR PRODUCING TONER

(75) Inventors: Yasukazu Ayaki, Kanagawa (JP); Hitoshi Itabashi, Kanagawa (JP); Yayoi Tazawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 10/152,771

(22) Filed: May 23, 2002

(65) Prior Publication Data

US 2003/0073020 A1 Apr. 17, 2003

(30) Foreign Application Priority Data

May 24, 2001 (JP) ..... 2001/156104
Sep. 28, 2001 (JP) ..... 2001/301330

(51) Int. Cl.[7] ..... G03G 9/093

(52) U.S. Cl. ..... 430/110.2; 430/137.15; 430/137.12; 430/137.11

(58) Field of Search ..... 430/110.2, 137.15, 430/137.12, 137.11

(56) References Cited

U.S. PATENT DOCUMENTS

| | | | | |
|---|---|---|---|---|
| 2,297,691 | A | 10/1942 | Carlson | |
| 4,694,035 | A | 9/1987 | Kasai et al. | 524/458 |
| 4,983,488 | A | 1/1991 | Tan et al. | 430/137 |
| 6,124,070 | A | 9/2000 | Baba et al. | 430/109 |

FOREIGN PATENT DOCUMENTS

| | | |
|---|---|---|
| JP | 36-10231 | 7/1961 |
| JP | 42-23910 | 11/1967 |
| JP | 43-10799 | 5/1968 |
| JP | 43-24748 | 10/1968 |
| JP | 51-14895 | 5/1976 |
| JP | 60-220358 | 11/1985 |
| JP | 61-215602 | 9/1986 |
| JP | 62-121701 | 6/1987 |
| JP | 63-205665 | 8/1988 |
| JP | 64-1702 | 1/1989 |
| JP | 3-237105 | 10/1991 |
| JP | 5-232741 | 9/1993 |
| JP | 11-218960 | 8/1999 |

*Primary Examiner*—Mark A. Chapman
(74) *Attorney, Agent, or Firm*—Fitzpatrick, Cella, Harper & Scinto

(57) ABSTRACT

A toner production process comprising the step of polymerizing a polymerizable monomer in the presence of (i) base particles containing at least a binder resin and (ii) a polymerization initiator. The polymerization initiator has in one molecule a hydrophilic moiety and a hydrophobic moiety and a reactive moiety between them, and the base particles are enlarged and/or surface-modified upon polymerization of the polymerizable monomer. Also disclosed is a toner having a circularity of from 0.92 to 1.0, which is produced by this process.

46 Claims, No Drawings

PROCESS FOR PRODUCING TONER

BACKGROUND OF THE INVENTION

1. Field of the Invention

This invention relates to a process for producing a toner for developing electrostatic latent images to form toner images in image-forming processes such as electrophotography and electrostatic printing, or a toner for forming toner images in an image-forming process of a toner jet system; and a toner obtained by this production process. More particularly, this invention relates to a process for producing a toner used in a fixing system in which these toner images are fixed to transfer mediums such as printing sheets by the action of heat and pressure.

2. Related Background Art

A number of methods as disclosed in U.S. Pat. No. 2,297,691, Japanese Patent Publications No. 42-23910 and No. 43-24748 and so forth are conventionally known as methods for electrophotography. In general, recorded images are obtained by forming an electrostatic latent image on a photosensitive member by utilizing a photoconductive material and by various means, subsequently developing the latent image by the use of a toner to form a toner image, and transferring the toner image to a transfer medium such as paper as occasion calls, followed by fixing by the action of heat, pressure, heat-and-pressure, or solvent vapor.

In the foregoing, as methods for developing electrostatic images by the use of toners or methods for fixing toner images to paper or the like, a variety of methods have ever been proposed, and methods suited for the intended image forming processes are employed. Then, toners used for such purpose have commonly been produced by pulverization processes in which colorants comprising dyes and/or pigments are melt-mixed and uniformly dispersed or dissolved in thermoplastic resins to form resin-colorant dispersions, and thereafter such molten products are cooled, followed by pulverization and classification by means of a fine grinding mill and a classifier, respectively, to produce toners having the desired particle diameters.

Reasonably good toners can be produced by such a process conventionally carried out for producing toners by pulverization, but there is a certain limit, i.e., a limit to the range in which toner materials are selected. For example, the above resin-colorant dispersions must be brittle enough to be pulverizable with ease by means of economically available production apparatus. However, such resin-colorant dispersions made brittle in order to meet these requirements tend to result in a broad range of particle diameter (particle size distribution) of the toner particles formed when actually pulverized at a high speed, especially causing a problem that fine particles are included in a relatively large proportion. Moreover, there is a problem that toners obtained from such highly brittle materials tend to be further finely pulverized or powdered when used for development in copying machines or the like.

In this method, it is also difficult to perfectly uniformly disperse solid fine particles of colorants or the like in the resin, and some toners may cause an increase in fog, a decrease in image density and a lowering of color mixing properties or transparency, depending on the degree of dispersion. Accordingly, care must be well taken when colorants are dispersed. Also, colorants and other internal additives may come bare to rupture sections of toner particles to cause fluctuations in developing performance.

In order to overcome the problems of the toners produced by such pulverization and also meet requirements for higher image quality, higher minuteness and lower energy consumption, toners produced by polymerization are energetically on researches. For example, Japanese Patent Publications No. 36-10231, No. 43-10799 and No. 51-14895 disclose methods of producing toners by suspension polymerization. Japanese Patent Applications Laid-open No. 60-220358 and No. 63-205665 also disclose methods of producing toners by emulsion polymerization; Japanese Patent Application Laid-open No. 61-273553, a method of producing a toner by dispersion polymerization; and Japanese Patent Application Laid-open No. 60-258203, a method of producing a toner by seed polymerization in which a monomer is absorbed in seed particles and the monomer is polymerized inside the seed particles.

Since these methods have no step of pulverization at all, colorants and other internal additives do not come bare to the surfaces of toner particles and hence the toner particles can have a uniform triboelectric charging performance. These methods have such an advantage. Also, since these methods make it possible to omit the step of classification, these are greatly effective for cost reduction on account of energy saving, reduction of production time, improvements in process yield and so forth.

In particular, the seed polymerization can make toners have higher function, e.g., in respect of the colorants and other internal additives coming bare to toner particle surfaces, enables additional formation of one or more binder resin layers on toner particle surfaces, or enables formation of a core/shell structure in which, e.g., a low-softening substance is encapsulated by changing the polarity of a monomer to be added, or enables surface modification of toner particles by using a compound with low surface energy such as fluorine resin. Thus, this is a technique desired to be further advanced.

In the above seed polymerization, researches have ever been put forward aiming principally at how a polymerizable monomer be fed to seed particles. For example, as disclosed in Japanese Patent Applications Laid-open No. 61-215602, No. 62-121701, No 64-1702 and No. 05-232741, in such a method a polymerizable monomer composition containing at least a polymerizable monomer and a polymerization initiator is first dispersed in the form of oil droplets in water containing a surface-active agent, and then the resultant dispersion is added to an aqueous dispersion of seed particles. As a consequence, the polymerizable monomer and the polymerization initiator dissolve out of the oil droplets into the water in a very small quantity, so that the polymerizable monomer and the polymerization initiator are absorbed into the seed particles, and finally the polymerization takes place in the interiors of the seed particles. In this method, the polymerizable monomer may be added in a quantity of approximately from 0.01-fold by weight to 1,000-fold by weight based on the weight of the seed particles. Hence, this method has applicability over a wide range, and has an advantage that it can employ formulation suited for various designs.

However, studies made by the present inventors have revealed that the above seed polymerization produces fine powder secondarily in a large quantity at the same time when the seed particles are enlarged, and the presence of such fine powder causes a lowering of performances of toner especially in an environment of high temperature and high humidity. Such fine powder is considered to be secondarily produced because emulsion polymerization or suspension polymerization takes place concurrently in the reaction system at its part other than the seed particles. More specifically, a surface-active agent is necessary in order to disperse the seed particles and the polymerizable monomer composition (oil droplets) in water, where the surface-active agent having been used to disperse the oil droplets come to remain in the system as the polymerizable monomer and so forth are absorbed from the oil droplets in the seed particles. Because of such an excess surface-active agent, the polymerizable monomer and polymerization initiator having dissolved out of the oil droplets into water in a very small quantity are not completely absorbed in the seed particles to make the emulsion polymerization or suspension polymerization take place concurrently in the reaction system to form the fine powder, as so considered.

For the purpose of solving the above problem, a method in which the seed polymerization is carried out in the presence of a water-soluble polymerization inhibitor is proposed as disclosed in Japanese Patent Application Laid-open No. 3-237105. This is a method in which only the seed polymerization is made to proceed in the interiors of seed particles so that any fine powder due to emulsion polymerization taking place concurrently in the water which is a dispersion medium can be kept from occurring to keep the whole fine powder less occur. Such a method can lessen the secondary production of the fine powder due to the emulsion polymerization taking place concurrently. However, according to studies made by the present inventors, this method has found not to be effective against the secondary production of the fine powder due to the suspension polymerization.

Meanwhile, as disclosed in Japanese Patent Application Laid-open No. 11-218960, a toner production method is proposed in which a water-soluble polymerization initiator is used when a polymerizable monomer capable of forming a polymer having a higher glass transition point than the glass transition point the seed particles have is polymerized to produce a toner having core-shell structure. However, according to studies made by the present inventors, the polymerizable monomer added in order to form the shell has found to undergo emulsion polymerization to form particles by itself and not to form any shells on the seed particle surfaces, because in such a method a surface-active agent and the water-soluble polymerization initiator are each used in a large quantity.

Accordingly, it has been sought to provide, in a toner production process in which shells are formed on core particles by seed polymerization, a process of producing a toner by seed polymerization with good efficiency, which can uniform the surface state and coverage of shells formed on individual seed particles and may less secondarily produce any impurities such as fine powder.

SUMMARY OF THE INVENTION

An object of the present invention is to provide a toner production process having solved the problems the above related background art has had. More specifically, an object of the present invention is to provide, in a toner production process having the step of seed polymerization to polymerize a polymerizable monomer in a dispersion medium in which base particles stand dispersed, a process of producing a toner by seed polymerization with good efficiency, which can control any scattering of coverage which may be caused between toner particles and besides may less secondarily produce the fine powder.

Another object of the present invention is to provide a toner having superior properties which is obtained by the above production process.

The above object can be achieved by the present invention described below. That is, the present invention is a process for producing a toner, having the step of polymerizing a polymerizable monomer in the presence of base particles containing at least a binder resin, to enlarge and/or surface-modify the base particles, wherein a polymerization initiator having in one molecule a hydrophilic moiety and a hydrophobic moiety and a reactive moiety between them is used in the above polymerization.

The present invention is also a toner comprising toner particles containing at least a binder resin, which toner particles have a circularity within the range of from 0.92 to 1.0;

the toner particles being toner particles obtained by polymerizing a polymerizable monomer in the presence of base particles containing at least a binder resin, using a polymerization initiator having in one molecule a hydrophilic moiety and a hydrophobic moiety and a reactive moiety between them, to enlarge and/or surface-modify the base particles.

DETAILED DESCRIPTION OF THE INVENTION

The present invention is described below in detail by giving preferred embodiments.

The present inventors have repeatedly made extensive studies in order to overcome the problems involved in the related background art discussed above. As the result, they have discovered that, in the process of producing a toner by seed polymerization, a compound having in one molecule a hydrophilic moiety and a hydrophobic moiety and a reactive moiety between them may be used as a polymerization initiator, and this enables achievement of the seed polymerization with good efficiency, which can control any scattering of coverage which may be caused between the toner particles to be obtained and besides may less secondarily produce the fine powder. Thus, they have accomplished the present invention.

More specifically, according to the toner production process of the present invention, it does not rely on the measure that the manner of feeding the polymerizable monomer used in seed polymerization is designed or any additional agent such as the water-soluble polymerization inhibitor is used, to keep the polymerization from taking place concurrently in the dispersion medium other than the base particles as done in the related art. Instead, a novel polymerization initiator simultaneously having in one molecule the ability to initiate polymerization and the ability to effect dispersion is used to make the polymerization initiator stationary to the base particle surfaces so that the polymerization reaction can be initiated only at the base particle surfaces. This enables achievement of the seed polymerization with good efficiency, without any secondary production of fine powder.

The reason therefor is considered as follows: According to the toner production process of the present invention, the polymerization initiator is made stationary to the base particle surfaces and the polymerization reaction is so controlled as to be initiated only at the base particle surfaces. Hence, the emulsion polymerization and suspension polymerization can be kept from taking place concurrently in the dispersion medium other than the base particles to lessen the secondary production of fine powder.

The polymerization initiator used in the toner production process of the present invention is characterized in that it is a compound having in one molecule a hydrophilic moiety and a hydrophobic moiety and a reactive moiety between them, and may preferably be a compound in which the hydrophobic moiety is one containing at least one group selected from an aliphatic hydrocarbon group having 5 to 60 carbon atoms, an aromatic hydrocarbon group having 6 to 60 carbon atoms, a heterocyclic group and a polysiloxane residual group; or the hydrophilic moiety is one containing at least one group selected from a polysaccharide group, a hydroxyl group, a sulfuric ester group, a sulfate, a sulfonic acid group, a sulfonic acid group having a salt structure, a carboxyl group, a carboxylate, a phosphoric ester group, a phosphate, a heterocyclic group, a heterocyclic salt, an amino group and an ammonium salt; or the reactive moiety is one having at least one group selected from an azo group, a peroxide group, a diketone group and a persulfuric acid group.

In particular, the polymerization initiator used in the present invention may preferably be a compound represented by the following Formula (1):

$$R^1—X—Z—Y—R^2 \quad (1)$$

wherein $R^1$ is a hydrophobic group, $R^2$ is a hydrophilic group, Z is a reactive group, and X and Y represent units which link with the groups represented by $R^1$ or $R^2$, respectively, and Z.

As a more preferred embodiment of the polymerization initiator used in the present invention, it may preferably be a compound in which the hydrophobic group $R^1$ of the compound represented by Formula (1) is at least one group selected from an aliphatic hydrocarbon group having 5 to 60 carbon atoms, an aromatic hydrocarbon group having 6 to 60 carbon atoms, a heterocyclic group and a polysiloxane residual group; or the hydrophilic group $R^2$ of the compound represented by Formula (1) is a group selected from a polysaccharide group, a hydroxyl group, a sulfuric ester group, a sulfate, a sulfonic acid group, a sulfonic acid group having a salt structure, a carboxyl group, a carboxylate, a phosphoric ester group, a phosphate, a heterocyclic group, a heterocyclic salt, an amino group, an ammonium salt, and an aliphatic hydrocarbon group or aromatic hydrocarbon group having at least one of these groups as a substituent. The compound may further preferably be one in which the aromatic hydrocarbon group has 1 to 20 carbon atoms or one in which the aromatic hydrocarbon group has 6 to 20 carbon atoms.

The compound may further preferably be one in which the group represented by Z in Formula (1) is an azo group, the units represented by X and Y are bonding or linking units which may be the same or different and each have at least one bond or linkage selected from a carbon-carbon bond, an ester linkage, an amide linkage, an ether linkage, a urethane linkage and a urea linkage, and any one of the units X and Y has an electron-attracting group.

As the polymerization initiator used in the toner production process of the present invention, it may also preferably be a compound represented by the following Formula (2):

$$R^{1a}—A^1—R^3—N{=}N—R^4—A^2—R^{2a} \quad (2)$$

wherein $R^{1a}$ is an aliphatic hydrocarbon group having 6 to 30 carbon atoms, or an aryl group having 6 to 12 carbon atoms which has as a substituent an alkyl group having 1 to 20 carbon atoms; $R^{2a}$ is at least one group selected from a carboxyl group, a carboxylate, a sulfuric ester group, a sulfate, a sulfonic acid group, a sulfonic acid group having a salt structure, and an aliphatic or aromatic hydrocarbon group having at least one of these groups as a substituent; $R^3$ and $R^4$ may be the same or different and are alkylene groups having electron-attracting groups on the carbon atoms adjoining to the azo group; $A^1$ may be absent, or represents at least one linkage selected from an ester linkage, an amide linkage, a urethane linkage and an ether linkage; and $A^2$ may be absent, or represents at least one linkage selected from an ester linkage, an amide linkage, a urethane linkage and an ether linkage.

As a still more preferred embodiment of the polymerization initiator used in the present invention, it may preferably be a compound in which the aliphatic hydrocarbon group represented by $R^{2a}$ in the compound represented by Formula (2) is one having 1 to 20 carbon atoms, or the aromatic hydrocarbon group represented by $R^{2a}$ in the compound represented by Formula (2) is one having 6 to 20 carbon atoms.

As a more preferred embodiment of the present invention, it may include an embodiment in which the base particles used in the present invention contain at least a colorant in addition to the binder resin. It may also include an embodiment in which the polymerization initiator used to enlarge and/or surface-modify such base particles is a radically polymerizable monomer. It may still also include an embodiment in which the resin formed by polymerization of the polymerizable monomer to be polymerized at the base particles has a glass transition point, and the glass transition point is within the range of from 35° C. to 100° C. It may further include an embodiment in which the polymerization initiator described above is added in an amount within the range of from 0.01% by weight to 20% by weight based on the weight of the base particles.

A still more preferred embodiment of the present invention may include a toner production process having, in the step of polymerizing the polymerizable monomer, the course of dispersing the base particles in an aqueous or hydrophilic medium by the use of the polymerization initiator and also the polymerizable monomer is added to the resultant dispersion to effect polymerization, and a toner production process having, in the step of polymerizing the polymerizable monomer in the presence of the base particles, the course of heating the system to a temperature which is higher by 5° C. to 40° C. than the glass transition point of the base particles. A preferred embodiment of the present invention may further include a toner production process which makes use of base particles having an endothermic peak at 45° C. to 120° C. in their differential thermal analysis, and a toner production process which makes use of base particles having a weight-average particle diameter within the range of from 0.5 μm to 9 μm.

Another preferred embodiment of the present invention is a toner comprising toner particles containing at least a binder resin, which is characterized in that the toner particles have a circularity within the range of from 0.92 to 1.0 and that the toner particles are those obtained by polymerizing a polymerizable monomer in the presence of base particles containing at least a binder resin, using a polymerization initiator having in one molecule a hydrophilic moiety and a hydrophobic moiety and a reactive moiety between them, to enlarge and/or surface-modify the base particles. In particular, the toner may include a toner in which the above binder resin is chiefly composed of a styrene-acrylate resin and/or a polyester resin, a toner which has an endothermic peak at a temperature ranging from 45° C. to 120° C. in the differential thermal analysis of the toner, a toner in which toner particles constituting the toner have a core/shell structure in which cores are covered with shells distinguishable by the ruthenium tetraoxide and/or osmium tetraoxide dyeing method, and a toner in which the base particles constituting the toner have a weight-average particle diameter within the range of from 0.5 μm to 9 μm.

The circularity in the above is used as a simple method for expressing the shape of particles quantitatively, and an index of the degree of surface unevenness of toner particles. It is indicated as 1.0 when the toner particles are perfectly spherical. The more complicate the surface shape is, the smaller the value of circularity is.

The polymerization initiator used in the present invention is described below in greater detail.

The polymerization initiator used in the present invention is, as described previously, characterized in that it is a compound having in one molecule a hydrophilic moiety and a hydrophobic moiety and a reactive moiety between them. In particular, the hydrophobic moiety may preferably be one containing at least one group selected from an aliphatic hydrocarbon group having 5 to 60 carbon atoms, an aromatic hydrocarbon group having 6 to 60 carbon atoms, a heterocyclic group and a polysiloxane residual group.

The aliphatic hydrocarbon group having 5 to 60 carbon atoms which constitutes the hydrophobic moiety of the above polymerization initiator may include, e.g., saturated or unsaturated, chainlike or branched-chain aliphatic hydrocarbon groups. Stated specifically, they may include alkyl groups having 5 to 60 (preferably 6 to 30) carbon atoms, such as hexyl, pentyl, 2-ethylhexyl, heptyl, octyl, nonyl, decyl, undecyl, dodecyl (lauryl), tridecyl, tetradecyl, pentadecyl, hexadecyl (cetyl), heptadecyl, octadecyl, nonadecyl, eicosyl, docosyl, hexacosyl (ceryl), triacontyl, hentriacontyl (melissyl), and α-olefin polymers; alkenyl groups having 5 to 60 (preferably 6 to 30) carbon atoms, such as hexenyl, tridecenyl, octadecadienyl, octadecenyl, nonadecenyl, docosenyl, hexacosenyl, and α-olefin polymers (olefinic oligomers having an unsaturated double bond); and alkynyl groups having 5 to 60 (preferably 6 to 30) carbon atoms, such as hexynyl and nonadecynyl.

The aliphatic hydrocarbon group having 5 to 60 carbon atoms may also be a saturated or unsaturated, cyclic aliphatic hydrocarbon group. Such a group may include cycloalkenyl groups having 6 to 60 (preferably 6 to 20) carbon atoms, such as cyclopentyl, cyclohexyl, cycloheptyl, cyclooctyl, cyclodecyl, cyclododecyl and cyclopentadecyl. It may also be a saturated or unsaturated, polycyclic hydrocarbon group, which may include groups corresponding to bicyclic hydrocarbon groups (cross-linked monocyclic saturated or unsaturated hydrocarbon groups) such as carane, pinane, bornane, norpinane and norbornane; and groups corresponding to tricyclic hydrocarbon groups (cross-linked polycyclic saturated or unsaturated hydrocarbon groups) such as adamantane.

The aromatic hydrocarbon group having 6 to 60 carbon atoms which constitutes the hydrophobic moiety of the above polymerization initiator may include, e.g., aryl groups such as phenyl, naphthyl, biphenyl, fluorenyl, anthracenyl, phenanthrenyl, benzanthracenyl, pyrenyl, triphenylenyl and peryrenyl; and also aryl groups having an alkyl group as a substituent, such as isopropylphenyl, butylphenyl, amylphenyl, hexylphenyl, octylphenyl, nonylphenyl, decylphenyl, dodecylphenyl and tetradecylphenyl (preferably, aryl groups having 6 to 12 carbon atoms having as a substituent an alkyl group having 1 to 20 carbon atoms).

The heterocyclic group which constitutes the hydrophobic moiety of the above polymerization initiator may include crown ethers such as 12-crown-4, 15-crown-5, 18-crown-6, dicyclohexano-24-crown-8, dibenzo-18-crown-6, cyclene, hexacyclene, 1-aza-12-crown-4, 1-aza-15-crown-5 and 1-aza-18-crown-6; heterocyclic compounds having an oxygen or nitrogen atom as a hetero-atom, such as tetraoxadiazacyclooctadecane and pentaoxadiazabicyclotricosane; porphyrins such as ethioporphyrin, octaethylporphyrin, protoporphyrin, hematoporphyrin, coproporphyrin, mesoporphyrin and tetraphenylporphyrin; and phthalocyanine, and naphthalocyanine.

The heterocyclic group as described above may hold a metal in the skeleton. The metal may include, e.g., alkali metals such as lithium, sodium and potassium; alkaline earth metals such as magnesium; periodic-table Group 13 metals such as aluminum and gallium; periodic-table Group 14 metals such as silicon, tin and lead; and transition metals such as vanadium, manganese, iron, cobalt, nickel, ruthenium, copper and zinc. An anion for any of these metals may also be present together. Such an anion may include halogen ions, organic-acid ions such as an acetate ion, inorganic-acid ions such as a sulfate ion, a tetrafluoroboron ion and a hexafluorophosphorus ion.

The polysiloxane residual group which constitutes the hydrophobic moiety of the above polymerization initiator may include, e.g., a group represented by the following formula:

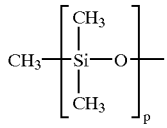

wherein p represents an integer of 5 to 30, and preferably 10 to 20.

Structural formulas of those which are preferred as the hydrophobic group constituting the hydrophobic moiety of the polymerization initiator used in the present invention are shown below.

The long-chain aliphatic hydrocarbon group may include the following:

$—C_nH_{2n+1}$, $—C_nH_{2n-1}$, $—C_nH_{2n-3}$, $—C_nH_{2n}R_{10}$ (n=5 to 60).

The aromatic hydrocarbon group having 6 to 60 carbon atoms and the heterocyclic group may include the following:

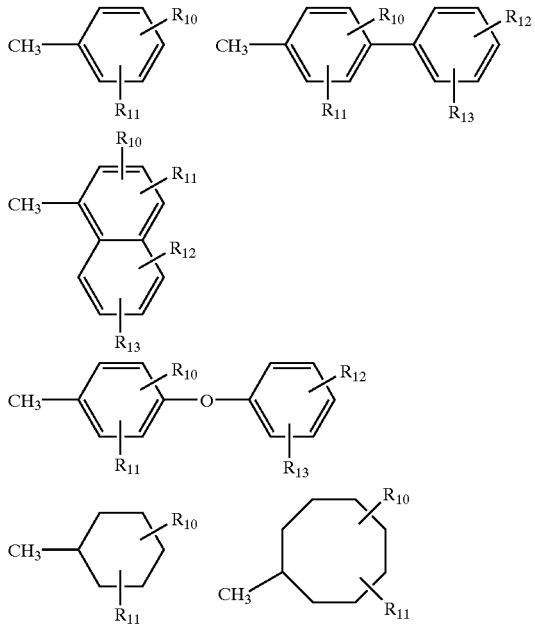

In the above structures, $R_{10}$ to $R_{13}$ may be absent, or may be the same or different, and each represent any of $—C_xH_{2x+1}$, $—COOC_xH_{2x+1}$, $—OCOC_xH_{2x+1}$, $—OC_xH_{2x+1}$, $—CONHC_xH_{2x+1}$, $—NHCOC_xH_{2x+1}$, $—C_xH_{2x}COOC_yH_{2y+1}$, $—C_xH_{2x}OCOC_yH_{2y+1}$, $—C_xH_{2x}OC_yH_{2y+}$, $—C_xH_{2x}CONHC_yH_{2y+1}$, —F, —Cl, Br and —I; and x and y each represent an integer.

The polysiloxane residual group may include a group having the following structure:

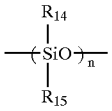

In the above structure, $R_{14}$ and $R_{15}$ may be the same or different, and each represent a hydrogen atom, an alkyl group, a haloalkyl group, or an aryl group which may have a substituent.

The hydrophobic group as described above may also include composite hydrophobic groups formed of hydrophobic groups of different types which stand linked with each other. These hydrophobic groups may further have a substituent of various types. The substituent may include a carbonyl group, a thiocarbonyl group, halogen atoms such as a fluorine atom, a chlorine atom, a bromine atom and an iodine atom, a hydroxyl group, a mercapto group, an oxime group, an imino group, an isocyanato group (isocyanate group), a thioisocyanato group (thioisocyanate group), a cyano group, primary to tertiary amino groups, a nitro group, a carboxyl group, chainlike hydrocarbon groups such as alkyl groups having 1 to 12 carbon atoms, and monocyclic aliphatic hydrocarbon groups such as cycloalkyl groups having 3 to 16 carbon atoms. Those containing a hydrophobic group as exemplified by perfluorophenyl, perfluoropentyl or perfluorododecyl are also preferred.

As the hydrophobic group constituting the hydrophobic moiety of the polymerization initiator used in the present invention, it may preferably be a group capable of sufficiently showing the hydrophobic function of a surface-active agent so that the polymerization initiator can function as a surface-active agent having the ability to effect dispersion. Accordingly, among the hydrophobic groups enumerated above, it is particularly preferable to use a polymerization initiator having as the hydrophobic moiety a long-chain aliphatic hydrocarbon group having 6 to 30 carbon atoms, more preferably a long-chain aliphatic hydrocarbon group having 10 to 22 carbon atoms, such as nonyl, dodecyl (lauryl), tetradecyl, hexadecyl (cetyl) and octadecyl; or an aryl group having 6 to 12 carbon atoms which has as a substituent an alkyl group having 1 to 20 carbon atoms, in particular, a phenyl group which has as a substituent an alkyl group having 6 to 20 carbon atoms, such as octylphenyl, nonylphenyl, decylphenyl and dodecylphenyl.

The polymerization initiator used in the present invention is characterized in that it is a compound having in one molecule a hydrophilic moiety and a hydrophobic moiety and a reactive moiety between them, where the hydrophilic moiety may include nonionic, anionic and cationic hydrophilic groups as shown below. For example, the hydrophobic moiety may preferably be one containing at least one group selected from a polysaccharide group, a hydroxyl group, a sulfuric ester group, a sulfate, a sulfonic acid group, a sulfonic acid group having a salt structure, a carboxyl group, a carboxylate, a phosphoric ester group, a phosphate, a heterocyclic group, a heterocyclic salt, an amino group and an ammonium salt. Any of these hydrophilic groups may be used alone or in combination of two or more types.

The polysaccharide group may include, e.g., sucrose esters, sorbitol, sorbitan, and sorbitan ester residual groups.

Where the hydrophilic group is an anionic group such as carboxylic acid or sulfonic acid group, it may form a salt with a base of various types. Such a base may include inorganic bases as exemplified by alkali metals such as lithium, sodium and potassium, alkaline earth metals such as magnesium, and ammonium; and organic bases as exemplified by amines.

The heterocyclic group may include groups corresponding to heterocyclic rings of 5 to 8 members, containing as a hetero-atom at least one atom selected from a nitrogen atom, an oxygen atom and a sulfur atom. In particular, a quaternary ammonium salt of a heterocyclic group having a nitrogen atom as a hetero-atom is preferred. For example, it may include a heterocyclic group represented by the following formula:

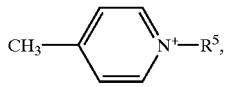

wherein $R^5$ represents an alkyl group.

The alkyl group represented by $R^5$ may include lower alkyl groups having 1 to 6 carbon atoms, such as methyl, ethyl, propyl and hexyl.

The amino group may be in the form of a secondary or tertiary amine, or a primary to quaternary ammonium (or salt), having as a substituent an aliphatic hydrocarbon group having 1 to 30 carbon atoms, such as a methyl group, an ethyl group, a propyl group, hexyl group or a lauryl group, or an aryl group having 6 to 12 carbon atoms which may have a substituent.

As the hydrophilic moiety constituting the polymerization initiator used in the present invention, it may further be those in which any of the hydrophilic groups enumerated above has been substituted with a substituent of various types. Such a substituent may include the substituents exemplified when the hydrophobic group is described above. The hydrophilic group may also include composite hydrophilic groups in which hydrophilic groups of different types are linked to each other.

Among those described above, particularly preferred hydrophilic groups may preferably be groups capable of sufficiently showing the hydrophilic function of a surface-active agent so that the polymerization initiator can function as a surface-active agent having the ability to effect dispersion. Such groups may include, e.g., a carboxyl group, a carboxylate, a sulfate, a sulfonic acid group and a sulfonic acid group having a salt structure.

Structural formulas of those which are preferred as the hydrophilic group constituting the hydrophilic moiety of the polymerization initiator used in the present invention are shown below.

The may include, e.g., —OH, $—CONR_1R_2$, —COOM (M represents a hydrogen atom, —Li, —Na or —K), $—SO_3M_1$, $—OSO_3M_1$, $—OPO_3M_1M_2$ ($M_1$ and $M_2$ may be the same or different, and each represent a hydrogen atom, $—NH_4^+$, —Li, —Na or —K), $—NR_1R_2$, $—N^+(R_1)(R_2)(R_3)M_4^-$ ($R_1$ to $R_3$ may be the same or different, and each represent a hydrogen atom, $—C_nH_{2n+1}$ (n is an integer), and $M_4$ represents —F, —Cl, Br or —I.

As hydrophilic groups having a cyclic structure, they may include the following:

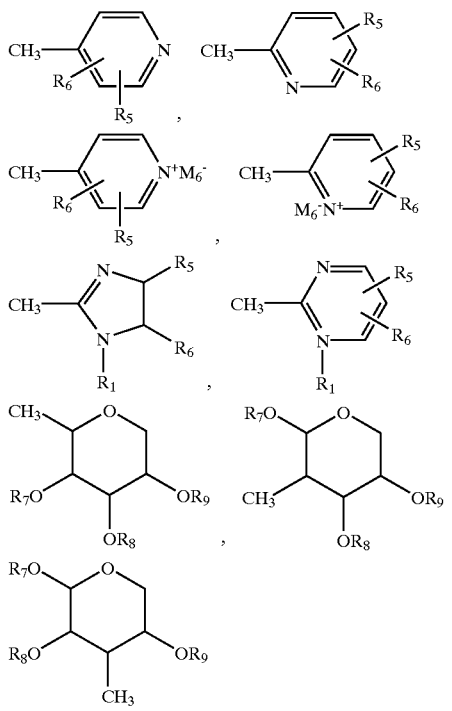

In the above structures, $R_5$ to $R_6$ may be absent, or may be the same or different, and each represent any of —OH, —COOM, $—SO_3M_1$, $—C_nH_{2n+1}$, $—C_nH_{2n}OH$, $—C_nH_{2n}COOM$, —F, —Cl, —Br and —I; M6 represents any of —F, —Cl, Br and —I; and $R_7$ to $R_9$ may be the same or different, and each represent any of —H, $—C_nH_{2n+1}$, $—(C_2H_4O)_nH$ and $—(C_3H_6O)_nH$.

The polymerization initiator used in the present invention is characterized in that it is a compound having in one molecule a hydrophilic moiety and a hydrophobic moiety and a reactive moiety between them, where the reactive moiety may include groups which function as polymerization initiators, as exemplified by groups capable of generating any of radicals, cations and anions by heat or light. Such groups may include, e.g., a polymerization initiation group such as an azo group, a peroxide group, a diketone group (α-diketone group) and a persulfuric acid group. The reactive group may preferably be a radical-generating group. Also, in order to stabilize the reactive group, the carbon atom adjoining to the reactive group may preferably be one having an electron-attracting group as exemplified by a cyano group, a halogen group or an amino group.

As described previously, the polymerization initiator used in the present invention may preferably be the compound represented by the following Formula (1):

$$R^1—X—Z—Y—R^2 \quad (1)$$

wherein $R^1$ is a hydrophobic group, $R^2$ is a hydrophilic group, Z is a reactive group, and X and Y represent units which link with the groups represented by $R^1$ or $R^2$, respectively, and Z.

The hydrophobic group represented by $R^1$ in the above Formula (1) may preferably be at least one group selected from an aliphatic hydrocarbon group having 5 to 60 carbon atoms, an aromatic hydrocarbon group having 6 to 60 carbon atoms, a heterocyclic group and a polysiloxane residual group. Also, the hydrophilic group represented by $R^2$ may preferably be a group selected from a polysaccharide group, a hydroxyl group, a sulfuric ester group, a sulfate, a sulfonic acid group, a sulfonic acid group having a salt structure, a carboxyl group, a carboxylate, a phosphoric ester group, a phosphate, a heterocyclic group, a heterocyclic salt, an amino group, an ammonium salt, and an aliphatic hydrocarbon group or aromatic hydrocarbon group having at least one of these groups as a substituent. The respective groups have already been described.

X and Y in the above Formula (1) represents units which link with the above groups $R^1$ or $R^2$, respectively, and the reactive group Z. A polymerization initiator preferred in the present invention may include those comprising a compound in which, in Formula (1), the group Z is the reactive group as described above, the units X and Y are units which may be the same or different and each have at least one bond or linkage selected from a carbon-carbon bond, an ester linkage, an amide linkage, an ether linkage, a urethane linkage and a urea linkage, and any one of the units X and Y has an electron-attracting group. The electron-attracting group may include, e.g., a cyano group, a halogen group or an amino group.

The unit X may appropriately be selected in accordance with the types of the groups $R^1$ and Z. The unit X is usually a unit having a linkage formed as a result of the reaction of the terminal of the group $R^1$ with the terminal of the group Z. There are no particular limitations on the type of the linkage. For example, where one terminal of the groups $R^1$ and Z is a carboxyl group and the other terminal thereof is a hydroxyl group, the group X has an ester linkage. Also, where one terminal of the groups $R^1$and Z is a hydroxyl group and the other terminal thereof is an isocyanate group, the group X has a urethane linkage. Where one terminal of the groups $R^1$and Z is an amino group and the other terminal thereof is a carboxyl group, the group X has an amide linkage. Still also, where one terminal of the groups $R^1$ and Z is an amino group and the other terminal thereof is an isocyanate group, the group X has a urea linkage.

The group Z in the above Formula (1) is a reactive group, and the polymerization initiation group such as an azo group, a peroxide group, a diketone group (α-diketone group) and a persulfuric acid group comes under that group. In the present invention, it may particularly preferably be an azo group.

In order to stabilize the reactive group Z, the carbon atom adjoining to the reactive group Z of the units X and Y may preferably be one having an electron-attracting group such as a cyano group, a halogen group or an amino group, and particularly preferably one having a cyano group. In particular, the both of these units X and Y may more preferably have electron-attracting groups on the carbon atoms adjoining to the reactive group Z and be the same.

Where in Formula (1) the reactive group Z is an azo group (—N=N—), the units X and Y may preferably be alkylene groups having 1 to 6 carbon atoms (inclusive of a methylene group) and having a methyl group and a cyano group on the carbon atoms adjoining to the azo group. Where the reactive group Z is a peroxide group (—O—O—), the units X and Y may usually preferably be alkylene groups having methyl groups on the carbon atoms adjoining to the peroxide group, as exemplified by 1,1-dimethyl-1-phenylmethyl group and 1,1-dimethylethyl group. Also, where the reactive group Z is an ester type peroxide group shown below, the units X and Y may also be phenylene groups or long-chain alkylene groups. Where the reactive group Z is a diketone group shown below, the units X and Y may also be phenylene groups.

Ester Type Peroxide Group:

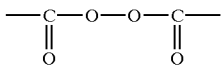

Diketone Group:

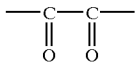

In the present invention, it is effective to use as the polymerization initiator the compound represented by the above Formula (1), in particular, a compound represented by the following Formula (2):

$$R^{1a}—A^1—R^3—N{=}N—R^4—A^2—R^{2a} \quad (2)$$

wherein $R^{1a}$ is an aliphatic hydrocarbon group having 6 to 30 carbon atoms, or an aryl group having 6 to 30 carbon atoms which has as a substituent an alkyl group having 1 to 20 carbon atoms; $R^{2a}$ is at least one group selected from a carboxyl group, a carboxylate, a sulfuric ester group, a sulfate, a sulfonic acid group, a sulfonic acid group having a salt structure, and an aliphatic or aromatic hydrocarbon group having at least one of these groups as a substituent; $R^3$ and $R^4$ may be the same or different and are alkylene groups having electron-attracting groups on the carbon atoms adjoining to the azo group; $A^1$ may be absent, or represents at least one linkage selected from an ester linkage, an amide linkage, a urethane linkage and an ether linkage; and $A^2$ may be absent, or represents at least one linkage selected from an ester linkage, an amide linkage, a urethane linkage and an ether linkage.

In the above Formula (2), $R^3$ and $R^4$ are alkylene groups having electron-attracting groups on the carbon atoms adjoining to the azo group, where the alkylene groups may include, e.g., alkylene groups having 1 to 6 carbon atoms, preferably 2 to 6 carbon atoms, such as methylene, ethylene, propylene and tetramethylene. Also, in the above Formula (2), preferably $R^{1a}$ may be a long-chain aliphatic hydrocarbon group having 10 to 22 carbon atoms, or a phenyl group which has as a substituent an alkyl group having 1 to 18 carbon atoms; $R^{2a}$ may be a carboxyl group, a carboxylate, a sulfuric ester group, a sulfate, a sulfonic acid group, a sulfonic acid group having a salt structure, or an aliphatic hydrocarbon group having 1 to 20 carbon atoms or aromatic hydrocarbon group having 6 to 20 carbon atoms which has at least one of these groups as a substituent; $R^3$ and $R^4$ may be the same or different and may be alkylene groups having 2 to 6 carbon atoms and having cyano groups on the carbon atoms adjoining to the azo group; $A^1$ may be absent, or may represent at least one linkage selected from an ester linkage and an amide linkage; and $A^2$ may be absent, or may represent at least one linkage selected from an ester linkage and an amide linkage.

There are no particular limitations on processes for producing the above characteristic polymerization initiator used in the present invention. Any process may be used as long as the compound obtained by reaction has in one molecule the hydrophilic moiety and the hydrophobic moiety and the reactive moiety between them, and can function as a surface-active agent having the ability to effect dispersion. The compound may preferably have the moieties corresponding to the groups or units $R^1$, $R^2$, X, Y and Z in the above Formula (1). For example, compounds corresponding to the groups or units $R^1$, $R^2$ X, Y and Z may respectively be allowed to react in order, or the unit X may be formed by the reaction of the terminal of the group $R^1$ with the terminal of the group Z and the unit Y by the reaction of the terminal of the group $R^2$ with the terminal of the group Z. For example, a compound having an azo group and having a carboxyl group at the terminal may be allowed to react with a compound having a functional group linkable with the carboxyl group and having the group $R^1$ or $R^2$.

In the toner production process of the present invention, the step of polymerizing a polymerizable monomer on the base particles containing a binder resin, to enlarge and/or surface-modify the base particles by the use of the polymerization initiator described above may specifically be carried out in the following way.

That is, as a preferred method, a method is available in which base particles are first dispersed in an aqueous or hydrophilic medium containing the characteristic polymerization initiator used in the present invention as described above, and then a polymerizable monomer is added to the resultant dispersion to effect polymerization. During the polymerization, the system may be stirred to such an extent that the base particles can be prevented from settling. Also, before the polymerization and during the polymerization, it is preferable that any dissolved oxygen in the polymerization reaction system is previously well removed by nitrogen flowing or the like. The polymerization may preferably be carried out at a temperature of 40° C. or above, commonly setting the temperature to 50° C. to 90° C. At the latter half of the polymerization reaction, the temperature may be raised.

In the present invention, as temperature conditions in carrying out the polymerization, it may also preferably have the course of heating the system to a temperature which is higher by 5° C. to 40° C. than the glass transition point (Tg) of the base particles. Polymerization carried out under such conditions enables well efficient production of enlarged and/or surface-modified toner particles having a circularity within the range of from 0.92 to 1.0, keeping the fine powder from being secondarily produced. The polymerization carried out under such conditions further enables easy production of a toner with superior running stability, having the core/shell structure in which cores are covered with shells distinguishable by the ruthenium tetraoxide and/or osmium tetraoxide dyeing method.

In the present invention, after the reaction carried out under such conditions has been completed, the toner particles formed may be washed, filtered or centrifuged to collect them, followed by drying, and optionally further addition of inorganic fine particles and so forth, to obtain a toner.

In the present invention, the polymerization initiator described above which is characteristic in the present invention may be used in any desired quantity depending on various factors such as polymerization conditions and desired toner composition. In general, it may preferably be used in an amount raging from 0.01% by weight to 20% by weight based on the base particles. Similarly, the aqueous or hydrophilic dispersion medium may, in general, preferably be used in an amount ranging from 2-fold to 20-fold by weight based on the base particles.

As the polymerizable monomer usable in the step of enlarging and/or surface-modifying the base particles, any known vinyl type polymerizable monomer may be used. Stated specifically, it may include styrene type polymerizable monomers such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic esters; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

As the polymerizable monomer to be polymerized at the base particles, it may also preferably be a radically polymerizable monomer, and the resin formed as a result of the polymerization of the polymerizable monomer may have a glass transition point, which glass transition point may preferably be within the range of from 35° C. to 100° C.

The polymerizable monomer as described above may be used in any desired quantity depending on various factors such as polymerization conditions and desired toner composition. In general, it may preferably be used in an amount raging from 0.01-fold by weight to 20-fold by weight based on the base particles.

In the step of enlarging and/or surface-modifying the base particles in the present invention, any known polymerization initiator may be used in combination with the above characteristic polymerization initiator used in the present invention. Such a polymerization initiator may include azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide.

However, the use of such a known polymerization initiator in a large quantity may bring about a possibility of producing the fine powder to lower the efficiency of seed polymerization. Hence, when it is used in combination, it may preferably be in a quantity not larger than that in which the characteristic polymerization initiator used in the present invention is added.

In the present invention, in order to control molecular weight, any known cross-linking agent or chain-transfer agent may also be added in the step of enlarging and/or surface-modifying the base particles. It may preferably be added in an amount of from 0.001% by weight to 15% by weight of the polymerizable monomer.

In the step of enlarging and/or surface-modifying the base particles in the present invention, any known dispersion stabilizer may be used in combination with the characteristic polymerization initiator used in the present invention. As the dispersion stabilizer used, it may include, e.g., as inorganic compounds, tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include, e.g., polyvinyl alcohol, gelatin, methyl cellulose, methyl hydroxypropyl cellulose, ethyl cellulose, carboxymethyl cellulose sodium salt, polyacrylic acid and salts thereof, polymethacrylic acid and salts thereof, sodium dodecylbenzenesulfate, sodium tetradecylsulfate, sodium pentadecylsulfate, sodium octylsulfate, sodium oleate, sodium laurate, sodium octylate, sodium stearate and calcium oleate. The use of such a dispersion stabilizer in a large quantity may bring about a possibility of producing the fine powder to lower the efficiency of seed polymerization. Hence, when it is used in combination, it may preferably be in a quantity not larger than 5-fold by weight of that in which the characteristic polymerization initiator used in the present invention is added.

The base particles used in the step of enlarging and/or surface-modifying the base particles in the present invention are described below.

Usable as the base particles used in the present invention are those produced by processes for producing known resin particles and/or toner particles, such as emulsion polymerization, suspension polymerization, dispersion polymerization, salting-out polymerization, association polymerization, mechanical pulverization and spray drying, and other known toner particles. The base particles used in the present invention may preferably be those containing at least a binder resin and a colorant. They may also be those further containing a low-softening substance such as wax and optionally a release agent and a charge control agent. In particular, it is preferable to use base particles having an endothermic peak at 45° C. to 120° C. in their differential thermal analysis. In the present invention, it is more preferable to use base particles having a weight-average particle diameter within the range of from 0.5 $\mu$m to 9 $\mu$m. This is because, if toner particles having a size outside this range are used, the resultant toner may have a low transfer performance or a low running stability.

In the present invention, it is preferable that the base particles as described above are dispersed in a dispersion medium containing the characteristic polymerization initiator and the polymerizable monomer is further added thereto to initiate polymerization in the interiors and/or on the surfaces of the base particles (i.e., at the base particles) to enlarge and/or surface-modify the base particles. In the toner production process of the present invention, carried out as described above, the polymerizable monomer used when the polymerizable monomer is added in order to effect seed polymerization may be incorporated with a colorant, a charge control agent and a release agent and besides organic or inorganic fine particles to prepare a polymerizable monomer composition, and this polymerizable monomer composition may be added to the dispersion medium to effect seed polymerization.

The binder resin for forming the base particles used in the present invention, all of those known in the art may be used.

For example, where the base particles are produced by a conventional, what is called pulverization process in which a thermoplastic resin is used as the binder resin and a colorant comprising a dye or a pigment or a charge control agent and so forth are melt-mixed and uniformly dispersed in the resin, followed by pulverization and classification by means of a fine grinding mill and a classifier, respectively, to produce toner particles having the desired particle diameter, any of resins as shown below may be used as the binder resin. For example, usable are resins including homopolymers of styrene and derivatives thereof such as such as polystyrene, poly-p-chlorostyrene and polyvinyltoluene; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-acrylonitrile-indene copolymer, a styrene-maleic acid copolymer and a styrene-maleic ester copolymer; polymethyl methacrylate, polybutyl methacrylate, polyvinyl chloride, polyvinyl acetate, polyethylene, polypropylene, polyester, polyurethane, polyamide, epoxy resins, polyvinyl butyral, polyacrylic resins, rosin, modified rosins, terpene resins, phenolic resins, aliphatic or alicyclic hydrocarbon resins, and aromatic petroleum resins; any of which may be used alone or in the form of a mixture.

Meanwhile, where the base particles are produced by a process for producing toners by polymerization, preferably usable as the polymerizable monomer are monomers including, e.g., styrene; styrene monomers such as o-, m- or p-methylstyrene, and m- or p-ethylstyrene; acrylic or methacrylic ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; butadiene, isoprene, cyclohexene, acrylo- or methacrylonitrile, and acrylic acid amide. Any of these may be used alone, or in the form of an appropriate mixture. Also, a monomer having two or more polymerizable functional groups in one molecule, like divinylbenzene, may be incorporated in any of these to form appropriate networks in the base particles. This enables more improvement in fixing performance and running performance of the toner. Polyester resin may further be incorporated in the base particles in an amount ranging from 0.1% by weight to 20% by weight based on the weight of the whole toner. This enables more improvement in the charging performance, fluidity and environmental stability of the toner produced in the present invention.

In the present invention, among those described above, it is particularly preferable to use base particles in which a styrene-acrylate resin and/or a polyester resin is/are used as the chief component(s) of the binder resin. The use of such resins can make the toner have good charging performance and fixing performance.

In the base particles used in the present invention, a wax as shown below may be incorporated. Such a wax may include, e.g., paraffin or polyolefin waxes, ester waxes, and modified products of these as exemplified by oxides and graft-treated products, as well as higher fatty acids and metal salts thereof, and amide waxes. The wax may be incorporated in an amount of from 0.1% by weight to 50% by weight based on the total weight of the toner. If it is incorporated in an amount of less than 0.1% by weight, the effect of keeping low-temperature offset from occurring may be poor. If it is in an amount of more than 50% by weight, the toner may have a poor long-term storage stability and also other toner materials may come poorly dispersed, resulting in a lowering of image characteristics, undesirably. The base particles used in the present invention may preferably be those containing the above wax and having an endothermic peak at 45° C. to 120° C. in their differential thermal analysis. If the base particles have an endothermic peak at below 45° C., they may have a poor long-term storage stability after they have been made into a toner. If on the other hand they have an endothermic peak at above 120° C., they may have a poor low-temperature anti-offset properties after they have been made into a toner.

As a polymerization initiator used when the base particles are produced by polymerization, usable are, e.g., azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide.

The quantity of such a polymerization initiator to be added may vary depending on the intended degree of polymerization. In general, it may be added in an amount ranging from 0.5% by weight to 20% by weight based on the weight of the monomer. The type of the polymerization initiator may a little differ depending on the method of polymerization. It may be used alone or in combination of two or more, making reference to the 10-hour half-life temperature. In order to control the degree of polymerization, any known cross-linking agent, chain-transfer agent, polymerization inhibitor and so forth may further be added.

As a dispersant used in the step of polymerization in an aqueous medium when the base particles are produced, it may include, e.g., as inorganic dispersants, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials, and ferrite. As organic compounds, it may include, e.g., polyvinyl alcohol, gelatin, methyl cellulose, methyl hydroxypropyl cellulose, ethyl cellulose, carboxymethyl cellulose sodium salt, and starch. Known nonionic, anionic and cationic surface-active agents may also be used. Stated specifically, they may include sodium dodecylsulfate, sodium tetradecylsulfate, sodium pentadecylsulfate, sodium octylsulfate, sodium oleate, sodium laurate, sodium stearate and calcium oleate. Any of these may be dispersed or dissolved in an aqueous phase when used. Any of these may preferably be used in an amount of from 0.2 part by weight to 10 parts by weight based on 100 parts by weight of the polymerizable monomer.

As the above inorganic dispersant, those commercially available may be used as they are. In order to obtain dispersed particles having a fine and uniform particle size, those obtained by forming the above inorganic compound in a dispersion medium under high-speed agitation may be used. For example, in the case of tricalcium phosphate, an aqueous sodium phosphate solution and an aqueous calcium chloride solution may be mixed under high-speed agitation to obtain a fine-particle dispersant preferable for the suspension polymerization. Also, in order to make these dispersants into fine particles, 0.001 to 0.1 part by weight of a surface active agent may be used in combination. As the surface-active agent usable here, commercially available nonionic, anionic or cationic surface active agents may be used. Stated specifically, those preferably usable are, e.g., sodium dodecylsulfate, sodium tetradecylsulfate, sodium pentadecylsulfate, sodium octylsulfate, sodium oleate, sodium laurate, potassium stearate and calcium oleate.

When the base particles are used by polymerization, the base particles may be produced by a process as described below. For example, a polymerizable monomer composition comprising the polymerizable monomer and added therein the colorant, the charge control agent, the polymerization initiator and other additives, having been uniformly dissolved or dispersed by means of a homogenizer, an ultrasonic dispersion machine or the like, is dispersed in an aqueous phase containing a dispersion stabilizer, by means of a conventional stirrer, or a homomixer, a homogenizer or the like to effect polymerization. Granulation is carried out preferably while controlling the agitation speed and time so that droplets formed of the polymerizable monomer composition can have the desired particle size. After the granulation, agitation may be carried out to such an extent that the state of particles is maintained and the particles can be prevented from settling, by the acton of the dispersion stabilizer. Here, the polymerization may be carried out at a polymerization temperature set at 40° C. or above, usually from 50 to 90° C. At the latter half of the polymerization, the temperature may be raised, and also the aqueous medium may be removed in part from the reaction system at the latter half of the reaction or after the reaction has been completed, in order to remove unreacted polymerizable monomers, by-products and so forth so that the durability of the base particles can be improved. After the reaction has been completed, the toner particles formed are collected by washing and filtration, followed by drying to form the base particles used in the present invention. In this method, water may usually be used as the dispersion medium preferably in an amount of from 300 to 3,000 parts by weight based on 100 parts by weight of the polymerizable monomer composition.

In the toner production process of the present invention, a colorant may be incorporated into the base particles or into the polymerizable monomer composition used when the base particles are enlarged and/or surface-modified. As the colorant used here, known pigments or dyes as show below may be used. For example, as black pigments, carbon black, copper oxide, manganese dioxide, aniline black, activated carbon, non-magnetic ferrite and magnetite may be used.

As yellow pigments, usable are, e.g., chrome yellow, zinc yellow, yellow iron oxide, cadmium yellow, mineral fast yellow, nickel titanium yellow, naples yellow, Naphthol Yellow S, Hanza Yellow G, Hanza Yellow 10G, Benzidine Yellow G, Benzidine Yellow GR, Quinoline Yellow Lake, Permanent Yellow NCG, and Tartrazine Yellow Lake.

As orange (reddish yellow) pigments, usable are, e.g., red chrome yellow, Molybdenum Orange, Permanent Orange GTR, Pyrazolone Orange, Vulcan Fast Orange, Benzidine Orange G, Indanthrene Brilliant Orange RK, and Indanthrene Brilliant Orange GK.

As red pigments, usable are, e.g., iron oxide red, cadmium red minimum, mercury sulfide, cadmium, Permanent Red 4R, Lithol Red, Pyrazolone Red, Watchung Red calcium salt, Lake Red C, Lake Red D, Brilliant Carmine 6B, Brilliant Carmine 3B, Eosine Lake, Rhodamine Lake B, and Alizarine Lake.

As blue pigments, usable are, e.g., iron blue, cobalt blue, Alkali Blue Lake, Victoria Blue Lake, Phthalocyanine Blue, Metal-free Phthalocyanine Blue, Phthalocyanine Blue partial chloride, Fast Sky Blue, and Indanthrene Blue BG.

As Violet pigments, usable are, e.g., manganese violet, Fast Violet B, and Methyl Violet Lake.

As green pigments, usable are, e.g., chromium oxide, chromium green, Pigment Green B, Malachite Green Lake, and Final Yellow Green G.

As white pigments, usable are, e.g., zinc white, titanium oxide, antimony white, and zinc sulfide.

As extenders, usable are, e.g., baryte powder, barium carbonate, clay, silica, white carbon, talc, and aluminum white.

As dyes, usable are, e.g., various dyes such as basic dyes, acid dyes, disperse dyes and direct dyes. Stated specifically, usable are, e.g., Nigrosine, Methylene Blue, Rose Bengale, Quinoline Yellow, and Ultramarine Blue.

Any of these pigments may be used alone, in the form of a mixture, or in the state of a solid solution. The colorant used in the present invention may be selected taking account of hue angle, chroma, brightness, weatherability, OHP transparency and dispersibility in toner particles. Also, the colorant may preferably be added in an an amount of from 1 to 20 parts by weight based on 100 parts by weight of the binder resin. In the case when a magnetic material is used as the black colorant, it may be used in an amount of from 30 to 150 parts by weight based on 100 parts by weight of the binder resin, which is different from that of other colorant.

Where a color toner having light transmission properties is produced by the toner production process of the present invention, pigments of various types and various colors as shown below may be used as colorants.

Yellow pigments may include, e.g., C.I. 10316 (Naphthol Yellow S), C.I. 11710 (Hanza Yellow 10G), C.I. 11660 (Hanza Yellow 5G), C.I. 11670 (Hanza Yellow 3G), C.I. 11680 (Hanza Yellow G), C.I. 11730 (Hanza Yellow GR), C.I. 11735 (Hanza Yellow A), C.I. 117408 (Hanza Yellow RN), C.I. 12710 (Hanza Yellow R), C.I. 12720 (Pigment Yellow L), C.I. 21090 (Benzidine Yellow), C.I. 21095 (Benzidine Yellow G), C.I. 21100 (Benzidine Yellow GR), C.I. 20040 (Permanent Yellow NCR), C.I. 21220 (Vulcan First Yellow 5) and C.I. 21135 (Vulcan First Yellow R).

Red pigments may include, e.g., C.I. 12055 (Staring I), C.I. 12075 (Permanent Orange), C.I. 12175 (Lithol Fast Orange 3GL), C.I. 12305 (Permanent Orange GTR), C.I. 11725 (Hanza Yellow 3R), C.I. 21165 (Vulcan First Orange GG), C.I. 21110 (Benzidine Orange G), C.I. 12120 (Permanent Red 4R), C.I. 1270 (Para Red), C.I. 12085 (Fire Red), C.I. 12315 (Brilliant Fast Scarlet), C.I. 12310 (Permanent Red F2R), C.I. 12335 (Permanent Red F4R), C.I. 12440 (Permanent Red FRL), C.I. 12460 (Permanent Red FRLL), C.I. 12420 (Permanent Red F4RH), C.I. 12450 (Light Fast Red Toner B), C.I. 12490 (Permanent Carmine FB) and C.I. 15850 (Brilliant Carmine 6B).

Blue pigments may include, e.g., C.I. 74100 (Metal-free Phthalocyanine Blue), C.I. 74160 (Phthalocyanine Blue) and C.I. 74180 (First Sky Blue).

In the case when the base particles are produced by polymerization, a surface-modified colorant may be used in order to improve the dispersibility of the colorant and control polymerization inhibitory properties.

In the present invention, a charge control agent may be added in the base particles to be used. As the charge control agent used here, all known agents are usable. It is preferable to use those having low polymerization inhibitory action and less aqueous-phase transfer properties. Such agents may include, e.g., as positive charge control agents, Nigrosine dyes, triphenylmethane dyes, quaternary ammonium salts, guanidine derivatives, imidazole derivatives and amine compounds. As negative charge control agents, they may include metal-containing salicylic acid compounds, metal-containing monoazo dye compounds, urea derivativesr styrene-acrylic acid resins and styrene-methacrylic acid resins. Any of these charge control agents may be added in an amount of from 0.1% by weight to 10% by weight based on the weight of the binder resin constituting the base particles.

Methods used in the present invention to measure various physical properties are described below together.

Measurement of average particle diameter of toner particles:

In the present invention, as a method for measuring the weight-average particle diameter of the toner, they are measured with a flow type particle image analyzer FPIA-1000, manufactured by Toa Iyou Denshi K.K. To make the measurement, 100 to 150 ml of water from which impurity solid matter and so forth have been removed is put in a container, and about 0.1 to 0.5 g of a surface-active agent, preferably an alkylbenzenesulfonate, is added thereto. In the mixture formed, a sample is dispersed to make dispersion treatment for 5 minutes by means of an ultrasonic dispersion machine. A dispersion formed adjusting the dispersion concentration to 3,000 to 10,000 particles/$\mu$l is used as a measuring sample, and number-average particle diameter determined with the above analyzer is used.

Measurement of glass transition point, and measurement of endothermic peaks:

(1) In the present invention, as a method for measuring the glass transition point, it is measured with a differential scanning calorimetry (DSC) instrument (M-DSC, manufactured by TA Instruments Co.). About 6 mg of a sample is weighed out, and this is put in a pan made of aluminum. An empty pan made of aluminum is used as a reference pan, and measurement is made in a measurement temperature range of from −40° C. to 200° C., in an atmosphere of nitrogen, at a heating rate of 4° C./minute, at a modulation amplitude of ±0.6° and at a frequency of 1/minute. From the resultant reversing heat flow curve, the glass transition point is determined by the middle-point method.

(2) Melting points of waxes used in the present invention are measured in the same manner as the above except for using wax as the measuring sample. Temperature at the endothermic peak top of the heat flow curve obtained is read as the melting point.

(3) Endothermic peaks are measured in the same manner as the above except for using toner particles as the measuring sample. Temperature at endothermic peaks appearing in the heat flow curve is measures.

Measurement of Circularity:

In the present invention, the circularity is used as a simple method for expressing the shape of toner particles quantitatively. In the present invention, dimensions of particle images are measured by the following method, using a flow type particle image analyzer FPIA-1000, manufactured by Toa Iyou Denshi K.K. On the basis of the resultant measurements, the value obtained according to the following equation (1) is defined as the circularity. Such circularity serves as an index of the degree of surface unevenness of toner particles. The circularity is indicated as 1.0 when the toner particles are perfectly spherical. The more complicate the surface shape is, the smaller the value of circularity is.

$$\text{Circularity } a = L_0/L \quad (1)$$

wherein $L_0$ represents the circumferential length of a circle having the same projected area as a particle image, and L represents the circumferential length of the projected image of the particle image.

As a specific method for the measurement, 0.1 to 0.5 ml of a surface-active agent, preferably an alkylbenzenesulfonate, as a dispersant is added to 100 to 150 ml of water from which any impurity solid matter has previously been removed. To this solution, 0.1 to 0.5 g of a sample to be measured is added. The resultant suspension in which the sample has been dispersed is subjected to dispersion treatment by means of an ultrasonic dispersion machine for about 3 minutes. Adjusting the dispersion concentration to 3,000 to 10,000 particles/$\mu$l and using the above analyzer, the shape of toner particles is measured.

Observation of core/shell structure:

In the present invention, the core/shell structure in toner particles is observed in the following way. As a specific method, first, thin-piece samples for measurement are obtained in the following way. Then, on the sample obtained, the form of cross sections of toner particles is observed using a transmission electron microscope (TEM). The thin-piece sample is obtained in the following way: Toner particles to be observed are well dispersed in a room-temperature curing epoxy resin, followed by curing at an atmospheric temperature of 40° C. for 2 days. The cured product obtained is electron-dyed with ruthenium tetraoxide ($RuO_4$) and optionally in combination with osmium tetraoxide ($OSO_4$). Thereafter, the thin-piece samples are cut out by means of an ultramicrotome having a diamond cutter.

Measurement of dissolved-oxygen content:

In the present invention, the dissolved-oxygen content in the polymerization system is measured with a dissolved-oxygen meter (dissolved-oxygen meter Model 3600, manufactured by Orbisfair Laboratories). A membrane used is of a type 29552A, which is made of PTFE (polytetrafluoroethylene) and is 50 $\mu$m in thickness. To make measurement, a liquid sample is fed from a flask to a flow cell of the dissolved-oxygen meter through a PTFE tube.

EXAMPLES

The present invention is described below in greater detail by giving Examples and Comparative Examples. The present invention is by no means limited by these Examples. In the following, "part(s)" and "%" are by weight.

First, polymerization initiators 1 to 6 used in Examples were prepared in the following way.

Polymerization Initiator

Preparation Example 1

5.6 g of 4,4'-azobis(4-cyanovaleric acid) was dissolved in 50 ml of THF (tetrahydrofuran). To the solution formed, 4.6 g of N-hydroxysuccinimide and 8.24 g of N,N'-dicyclohexylcarbodimide were added, followed by stirring at room temperature for 24 hours. Thereafter, the THF was distilled off, and the residue formed was dispersed in 500 ml of acetone to remove a precipitate. The acetone was further distilled off to obtain crystals of a diester of 4,4'-azobis(4-cyanovaleric acid).

Next, 1.76 g of the above crystals were dissolved in 35 ml of DMF (dimethylformamide). To the solution formed, 0.74 g of dodecylamine was added, followed by stirring overnight. The reaction mixture obtained was introduced into 300 ml of water, and the precipitate having separated out was filtered and washed with water, and thereafter again dissolved in dimethoxyethane, followed by drying with magnesium sulfate. Thereafter, the solvent was distilled off, and the residue was washed with ethyl acetate and dried to obtain a product in which one ester of the diester was replaced with dodecylamine.

Subsequently, 1.7 g of the dried product was dispersed in 20 ml of methanol. To the dispersion formed, 1.6 ml of 2N NaOH was added, and the mixture formed was stirred at room temperature. The ester having remained was hydrolyzed to obtain the following desired compound 1.

Compound 1

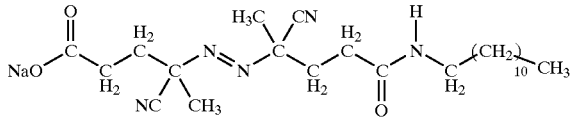

Polymerization Initiator

Preparation Example 2

2.72 g of the product in which one ester of the diester was replaced with dodecylamine, obtained in the same manner as in Polymerization Initiator Preparation Example 1, was dispersed in 40 ml of methanol. To the dispersion formed, 0.87 g of sulfanilic acid was added, and the mixture formed was stirred overnight. Then, 0.03 ml of 0.5N NaOH was added to obtain the following desired compound 2.

Compound 2

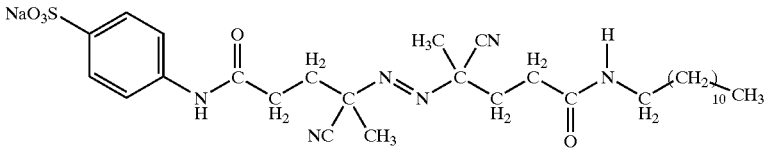

Polymerization Initiator

Preparation Example 3

The following desired compound 3 was obtained in the same manner as in Polymerization Initiator Preparation Example 1 except that 0.41 g of n-hexylamine was used in place of 0.74 g of the dodecylamine.

Compound 3

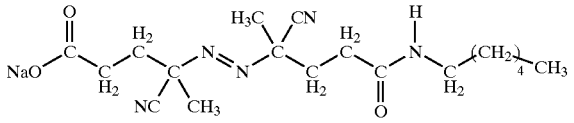

Polymerization Initiator

Preparation Example 4

The following desired compound 4 was obtained in the same manner as in Polymerization Initiator Preparation Example 1 except that 1.08 g of stearylamine was used in place of 0.74 g of the dodecylamine.

Compound 4

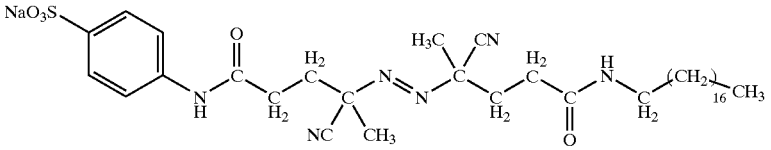

Polymerization Initiator

Preparation Example 5

The following desired compound 5 was obtained in the same manner as in Polymerization Initiator Preparation Example 1 except that 1.41 g of tetracosylamine was used in place of 0.74 g of the dodecylamine.

Compound 5

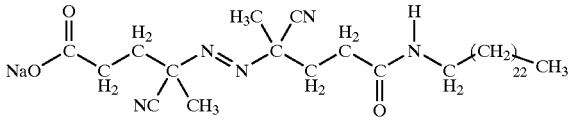

Polymerization Initiator

Preparation Example 6

The following desired compound 6 was obtained in the same manner as in Polymerization Initiator Preparation Example 2 except that 0.63 g of decylamine was used in place of 0.74 g of the dodecylamine and 0.63 g of 2-aminoethanesulfonic acid was used in place of 0.87 g of the sulfanilic acid.

Compound 6

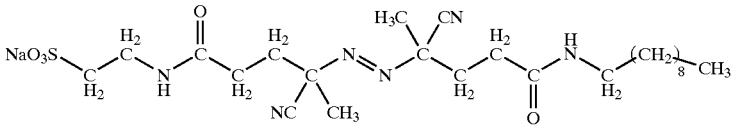

Base Particles

Production Example 1

Into a polymerization reaction vessel, 800 parts by weight of ion-exchanged water, 480 parts by weight of an aqueous 0.1M-$Na_3PO_4$ solution were introduced, and the mixture was heated to 70° C., followed by stirring at 13,000 rpm using a TK-type homomixer (manufactured by Tokushu Kika Kogyo Co., Ltd.). Then, 74 parts by weight of an aqueous 1.0M-$CaCl_2$ solution was added thereto little by little to obtain an aqueous dispersion medium containing a fine-particle slightly water-soluble dispersion stabilizer.

Meanwhile, a disperse phase (dispersoid) was prepared in the following way.

| | |
|---|---|
| Styrene | 140 parts |
| n-Butyl acrylate | 35 parts |
| Carbon black | 16 parts |
| Charge control agent (iron complex of monoazo dye) | 5 parts |
| Ester wax (softening point: 70° C.) | 15 parts |

The above materials were well mixed. Keeping the resultant mixture at 70° C., 8 parts by weight of 2,2'-azobis(2,4-dimethylvaleronitrile) as a polymerization initiator was added and dissolved therein to obtain a polymerizable monomer composition.

The above polymerizable monomer composition was introduced into the aqueous dispersion medium previously prepared in a polymerization reaction vessel. Then, these were stirred at 70° C. for 18 minutes at 10,000 rpm by means of a TK-type homomixer kept in a nitrogen atmosphere, to granulate the polymerizable monomer composition. Thereafter, stirring with paddle stirring blades, the polymerizable monomer was polymerized at 70° C. for 10 hours. After the polymerization reaction was completed, the reaction product was cooled, and thereafter hydrochloric acid was added to dissolve $Ca_3(PO_4)_2$, followed by filtration and washing to obtain an aqueous dispersion with a solid content of 30% by weight. Base particles 1 thus formed had a weight-average particle diameter of 5.6 $\mu$m. Also, as a result of measurement by DSC, the base particles 1, prepared as described above, were found to have a glass transition point at 59° C. and an endothermic peak at 75° C.

Example 1

Into a polymerization vessel fitted with a mechanical stirrer and a feed pipe for nitrogen bubbling, 600 parts by weight of water, 3 parts by weight of the compound 1, shown in Table 1, and 1.0 part by weight of sodium dodecylsulfate were introduced, and 300 parts by weight of the base particles 1 (colored resin particles), obtained in Base Particles Production Example 1, were further put into it. Further, keeping the inside of the system at 20° C., nitrogen was fed through the nitrogen bubbling feed pipe to carry out bubbling until the dissolved-oxygen content in the system came to be 0.1 mg/liter. Thereafter, the polymerization vessel was heated to 70° C., where 20 parts by weight of styrene as a polymerizable monomer was dropwise added over a period of 3 hours. In this state, the polymerization vessel was kept at 75° C., and the polymerization was carried out with stirring over a period of 10 hours. Also, the nitrogen bubbling was continued during the polymerization.

After the reaction was completed, the reaction product was left at rest, and how its supernatant liquid stood was observed. The supernatant liquid was found to be colorless, and also any fine powder was found not to have been produced by emulsion polymerization.

The above fluid dispersion was washed and then dried to obtain toner particles. The state of coating of the toner particles was observed with a scanning electron microscope S-4700 (manufactured by Hitachi Ltd.) to make evaluation.

To 100 parts by weight of the toner particles, 2 parts by weight of hydrophobic silica was externally added and mixed to produce a toner.

Evaluation

Then, 5 parts by weight of the toner thus obtained and 95 parts by weight of a silicone-resin-coated magnetic ferrite carrier were blended to prepare a two-component developer. Using this two-component developer, image reproduction was tested using a full-color laser copying machine CLC-500, manufactured by CANON INC. As a result, good images were obtained.

The results were as shown in Table 2. Criteria of image evaluation and criteria of evaluation on the results obtained when the surface state of the toner particles was observed were as shown below.

Evaluation of the surface state of base particles:

A: The particle surfaces stand coated uniformly, and this state of coating does not differ between particles.

B: The state of coating does not differ between particles, but fine powder has secondarily been produced in a small quantity and the fine powder stands attached to the particle surfaces.

C: The state of coating differs partly, or the fine powder produced secondarily stands attached to the particle surfaces in a little large quantity.

D: The particle surfaces do not stand coated sufficiently, or the fine powder produced secondarily stands attached to the particle surfaces in a very large quantity.

Image evaluation:

A: Dots are not disordered, and even fine dots stand reproduced, showing very good results.

B: Any spots around line images are not seen. Dots are slightly non-uniform in shape, but showing good results.

C: Spots around line images are seen, and dots are non-uniform in shape, but no problem in practical use.

D: Spots around line images are greatly seen, and dots are greatly non-uniform in shape.

E: Not developed at the places where the dots are to be, or spots around line images are very greatly seen.

Examples 2 to 8

Toners were respectively produced in the same manner as in Example 1 except that polymerization initiators shown in Table 1 were used and the toners were constructed as shown in Table 2. The toners thus obtained were evaluated in the same manner as in Example 1. The results of surface-state and image evaluation obtained were as shown in Table 2.

Comparative Example 1

A toner was produced in the same manner as in Example 1 except that a polymerization initiator shown in Table 1 was used and the toner was constructed as shown in Table 2. After the reaction was completed, the reaction product was left at rest, and how its supernatant liquid stood was observed to find that the supernatant liquid stood cloudy and that fine powder ascribable to suspension polymerization was secondarily produced in a large quantity. Also, the dispersion after reaction was washed and dried, and the surface state of particles thus obtained was observed to find that fine particles stayed attached to particle surfaces in a very large quantity.

Images were reproduced in the same manner as in Example 1, and evaluation was made in the same manner and according to the same criteria as those in Example 1 to find that any sufficient image density was not attained and coarse images were formed. Results obtained were as shown in Table 2.

Comparative Example 2

A toner was produced in the same manner as in Example 1 except that a polymerization initiator shown in Table 1 was used and the polymerization initiator was dissolved and added in the polymerizable monomer. After the reaction was completed, the reaction product was left at rest, and how its supernatant liquid stood was observed to find that the supernatant liquid stood cloudy and that fine powder ascribable to suspension polymerization was secondarily produced in a large quantity. Also, the dispersion after reaction was washed and dried, and the surface state of particles thus obtained was observed to find that fine particles stayed attached to particle surfaces in a very large quantity and that coarse particles were also secondarily produced.

Images were reproduced in the same manner as in Example 1, and evaluation was made in the same manner and according to the same criteria as those in Example 1 to find that any sufficient image density was not attained and coarse images were formed. Results obtained were as shown in Table 2.

TABLE 1

Polymerization Initiators Used in Examples and Comparative Examples

| Compound | |
|---|---|
| 1 | Compound of PI Preparation Example 1 *1 |
| 2 | Compound of PI Preparation Example 2 *1 |
| 3 | Compound of PI Preparation Example 3 *1 |
| 4 | Compound of PI Preparation Example 4 *1 |
| 5 | Compound of PI Preparation Example 5 *1 |
| 6 | Compound of PI Preparation Example 6 *1 |
| 7 | 4,4'-Azobis(4-cyanovaleric acid) *2 |
| 8 | 2,2'-Azobis(2,4-dimethylvaleronitrile) *3 |

PI: Polymerization Initiator
*1: Polymerization initiator used in Example
*2: Water-soluble polymerization initiator
*3: Oil-soluble polymerization initiator

TABLE 2

Chief Construction of Production Process in Examples and Comparative Examples, And Evaluation Results on Toner Obtained

| | Polymerization initiator | | Polymerizable monomer to be polymerized at base particles | | Amount of sodium dodecylsulfate | Evaluation | |
|---|---|---|---|---|---|---|---|
| | Compound (pbw) | Amount (pbw) | Compound | Amount (pbw) | | (1) | (2) |
| Example: | | | | | | | |
| 1 | 1 | 3 | styrene | 20 | 1.0 | A | A |
| 2 | 2 | 3 | styrene | 20 | 0 | A | A |
| 3 | 3 | 2 | styrene | 20 | 4.0 | B | B |
| 4 | 1 | 5 | styrene<br>n-butyl acrylate | 82<br>8 | 0 | B | A |
| 5 | 5 | 4 | styrene | 30 | 3.0 | C | B |
| 6 | 4 | 1 | styrene | 12 | 3.0 | A | B |
| 7 | 6 | 6 | styrene<br>n-butyl acrylate | 40<br>10 | 0 | B | B |
| 8 | 3 | 6 | styrene<br>n-butyl acrylate | 62<br>18 | 3.0 | C | C |

TABLE 2-continued

Chief Construction of Production Process in Examples and Comparative Examples, And Evaluation Results on Toner Obtained

| | Polymerization initiator | | Polymerizable monomer to be polymerized at base particles | | Amount of sodium dodecylsulfate | Evaluation | |
|---|---|---|---|---|---|---|---|
| | Compound (pbw) | Amount | Compound (pbw) | Amount (pbw) | | (1) | (2) |
| Comparative Example: | | | | | | | |
| 1 | 7 | 3 | styrene | 20 | 4.0 | D | D |
| 2 | 8 | 3 | styrene | 20 | 4.0 | D | E |

(1): Surface state
(2): Image quality

Base Particles

Production Example 2

| | |
|---|---|
| Polyester resin (acid value: 6) | 100 parts |
| Phthalocyanine pigment (C.I. Pigment Blue 15:3) | 4 parts |
| Ester wax (melting point: 84° C.) | 3 parts |
| Di-t-butylsalicylic acid aluminum compound | 5 parts |

The polyester resin used here was one obtained by condensation polymerization of polyoxypropylene (2,2)-2,2,-bis(4-hydroxyphenyl) propane with fumaric acid and 1,2,5-hexanetricarboxylic acid. Its acid value was 6.

The above materials were well premixed by means of a Henschel mixer, and the mixture formed was melt-kneaded at a temperature of about 140° C. by means of a twin-screw extruder. After the kneaded product obtained was cooled, this was crushed into particles of about 1 to 2 mm in diameter, using a hammer mill, followed by pulverization by means of a fine grinding mill of an air jet system. The pulverized product obtained was classified to obtain base particles 2 having a weight-average particle diameter of 6.5 μm and a circularity of 0.914. As a result of measurement by DSC, the base particles 2 were found to have a glass transition point at 56° C. and an endothermic peak at 84° C.

Example 9

Into a polymerization vessel fitted with a mechanical stirrer and a feed pipe for nitrogen bubbling, 500 parts by weight of water, 3 parts by weight of the compound 2, shown in Table 1, and 0.5 part by weight of sodium dodecylsulfate were introduced, and 80 parts by weight of the base particles 2, obtained in Base Particles Production Example 2, were further put into it. Further, keeping the inside of the system at 20° C., nitrogen was fed through the nitrogen bubbling feed pipe to carry out bubbling until the dissolved-oxygen content in the system came to be 0.1 mg/liter. Thereafter, the polymerization vessel was heated to 70° C., where 20 parts by weight of styrene and 4 parts by weight of n-butyl acrylate as polymerizable monomers were dropwise added over a period of 3 hours. In this state, the polymerization vessel was kept at 65° C., and the polymerization was carried out with stirring over a period of 15 hours. Also, the nitrogen bubbling was continued during the polymerization. Thereafter, the polymerized product was filtered, washed, and then dried to obtain toner particles. The circularity of the toner particles obtained was measured to find that it was 0.986.

Meanwhile, 100 parts of hydrophilic fine titanium oxide powder (average particle diameter: 0.02 μm; BET specific surface area; 145 $m^2/g$) was surface-treated with 22 parts of n-C4H9-Si—$(OCH_3)$3 to obtain hydrophobic fine titanium oxide powder having an average particle diameter of 0.02 μm and a hydrophobicity of 70%. Then, 98.3 parts of the toner particles having been obtained and 1.7 parts of this hydrophobic fine titanium oxide powder were mixed to make up a toner.

5 parts of the toner thus obtained and 95 parts by weight of a coated magnetic ferrite carrier (average particle diameter: 45 μm) having been coated with about 1% by weight of silicone resin were blended to prepare a two-component developer. This two-component developer was put in a full-color digital copying machine CLC-800, manufactured by CANON INC., and image reproduction was tested on 10,000 sheets in a normal temperature and normal humidity environment (23° C./60% RH), setting contrast voltage at 250 V, successively supplying the toner in a monochromatic mode, and using an original having an image area percentage of 25%. Results obtained were as shown in Tables 3 and 4.

Base Particles

Production Examples 3 to 5

Base particles 3 to 5 were obtained in the same manner as in Base Particles Production Example 2 except that the colorant was changed to C.I. Pigment Yellow 17, C.I. Pigment Red 202 and carbon black, respectively.

Examples 10 to 12

Toners were produced respectively in the same manner as in Example 9 except that the base particles used were changed to the base particles 3 to 5 produced in Base Particles Production Examples 3 to 5. Evaluation was made in the same way to find that good images were obtained. Results obtained were as shown in Tables 3 and 4.

Comparative Example 3

Toner particles were obtained in the same manner as in Example 9 except that in place of the compound 1, shown in Table 1, the compound 7 was used. The circularity of the toner particles obtained was 0.951. Using the toner particles thus obtained, a toner was prepared in the same manner as in Example 9, and evaluation was made in the same way. Results obtained were as shown in Tables 3 and 4.

Base Particles

Production Example 6

| | |
|---|---|
| Styrene-butyl acrylate-monoethyl maleate copolymer | 100 parts |
| Magnetic iron oxide | 90 parts |
| Low-molecular-weight propylene-ethylene copolymer | 4 parts |
| Iron complex of monoazo dye | 2 parts |

The styrene-butyl acrylate-monoethyl maleate copolymer used here was one having a weight-average molecular weight of 200,000, having in its molecular weight distribution a main peak at molecular weight of 38,000 and a sub-peak at molecular weight of 380,000, and having an acid value of 6. The magnetic iron oxide was one having a number-average particle diameter of 0.18 $\mu$m, and having Hc of 121 oersteds, $\sigma s$ of 83 emu/g and $\sigma r$ of 11 emu/g as magnetic properties under application of 10 kiro-oersteds.

The above materials were premixed by means of a Henschel mixer, and the mixture formed was melt-kneaded at a temperature of about 130° C. by means of a twin-screw extruder. After the kneaded product obtained was cooled, this was crushed using a hammer mill, followed by pulverization by means of a fine grinding mill making use of jet streams. The pulverized product obtained was further classified using an air classifier to obtain base particles 6 having a weight-average particle diameter of 7.3 $\mu$m. As a result of measurement by DSC, the base particles 6 were found to have a glass transition point at 64° C. and an endothermic peak at 105° C.

Example 13

Into a polymerization vessel fitted with a mechanical stirrer and a feed pipe for nitrogen bubbling, 500 parts by weight of water, 3 parts by weight of the compound 2, shown in Table 1, and 0.5 part by weight of sodium dodecylsulfate were introduced, and 180 parts by weight of the base particles 6, obtained in Base Particles Production Example 6, were further put into it. Further, keeping the inside of the system at 20° C., nitrogen was fed through the nitrogen bubbling feed pipe to carry out bubbling until the dissolved-oxygen content in the system came to be 0.1 mg/liter. Thereafter, the polymerization vessel was heated to 80° C., where 40 parts by weight of styrene as a polymerizable monomer was dropwise added over a period of 3 hours. In this state, the polymerization vessel was kept at 80° C., and the polymerization was carried out with stirring over a period of 15 hours. Also, the nitrogen bubbling was continued during the polymerization. Thereafter, the polymerized product was filtered, washed, and then dried to obtain toner particles.

100 parts by weight of the toner particles thus obtained and 0.6 part by weight of hydrophobic fine silica powder were mixed to make up a magnetic toner having hydrophobic silica on its toner particle surfaces. The circularity of the toner particles obtained was 0.963.

This magnetic toner was put in a copying machine GP-215, manufactured by CANON INC., and image reproduction was tested on 10,000 sheets in a normal temperature and normal humidity environment (23° C./60% RH) to make evaluation in the same way. Results obtained were as shown in Tables 3 and 4.

Example 14

Toner particles were obtained in the same manner as in Example 13 except that the amount of styrene used as a polymerizable monomer was changed to 15 parts by weight and the polymerization was carried out keeping the polymerization vessel at 70° C. The circularity of the toner particles thus obtained was 0.937. A magnetic toner was also prepared in the same manner as in Example 13, and evaluation was made in the same way. Results obtained were as shown in Tables 3 and 4.

Comparative Example 4

Toner particles were obtained in the same manner as in Example 14 except that in place of the compound 1, the compound 8, shown in Table 1, was used. The circularity of the toner particles thus obtained was 0.918. A magnetic toner was also prepared in the same manner as in Example 14, and evaluation was made in the same way. Results obtained were as shown in Tables 3 and 4.

Evaluation

The evaluation of the toners of Examples 9 to 14 and Comparative Examples 3 and 4 was made in such a manner as shown below.

Observation of core/shell structure:

On the basis of cross-sectional observation of 20 toner particles by the ruthenium tetraoxide and/or osmium tetraoxide dyeing method, evaluation was made according to the following criteria.

A: Cores do not stand bare to the surfaces in cross sections of 80% by number or more of particles.

B: Cores do not stand bare to the surfaces in cross sections of 50% by number or more of particles.

C: Cores do not stand bare to the surfaces in cross sections of less than 50% by number of particles, or the core/shell structure is not seen.

Solid-image uniformity:

An original was copied in which circles 20 mm in diameter having an image density of 1.5 as measured with a reflection densitometer RD918 (manufactured by Macbeth Co.) are provided at five spots. The image density at image areas was measured with the reflection densitometer RD918, and the difference between the maximum value and the minimum value thus measured was determined.

Transfer performance:

A solid image was formed by development on a photosensitive drum. In the middle of transfer, the developing machine was stopped. The toner held on the photosensitive drum was collected with a Mylar tape, and fixed to a white background area on a transfer sheet. The toner on the transfer sheet was also fixed thereto with a Mylar taps. Transfer performance was calculated according to the following expression.

Transfer performance=(Macbeth density on transfer sheet)/(Macbeth density on drum)×100

Highlight area image quality:

Image quality at highlight areas was visually evaluated according to the following evaluation criteria.

A: Dots are not disordered, and even fine dots stand reproduced, showing very good results.

B: Any spots around line images are not seen. Dots are slightly non-uniform in shape, but showing good results.

C: Spots around line images are seen, and dots are non-uniform in shape, but no problem in practical use.

D: Spots around line images are greatly seen, and dots are greatly non-uniform in shape.

E: Not developed at the places where the dots are to be, or spots around line images are very greatly seen.

TABLE 3

Properties of Toner Particles of Examples 9–14 And Comparative Examples 3, 4

| | Base particles | | | Toner particles | | | |
|---|---|---|---|---|---|---|---|
| | Type | Glass transition point (° C.) | Circularity | Particle diam. (μm) | Circularity (° C.) | Endothermic peak | Core/shell structure |
| Example: | | | | | | | |
| 9 | 2 | 56 | 0.914 | 6.5 | 0.986 | 84 | A |
| 10 | 3 | 56 | 0.912 | 6.5 | 0.982 | 84 | A |
| 11 | 4 | 56 | 0.915 | 6.5 | 0.987 | 84 | A |
| 12 | 5 | 56 | 0.916 | 6.4 | 0.979 | 84 | A |
| 13 | 6 | 64 | 0.894 | 7.4 | 0.963 | 105 | A |
| 14 | 6 | 64 | 0.894 | 7.1 | 0.937 | 105 | B |
| Comparative Example: | | | | | | | |
| 3 | 2 | 56 | 0.914 | 11.3 | 0.951 | 84 | C |
| 4 | 6 | 64 | 0.894 | 6.8 | 0.918 | 105 | C |

TABLE 4

Image Evaluation Results of Toners of Examples 9–14 And Comparative Examples 3, 4

| | Initial stage | | | After 10,000 sheets | | |
|---|---|---|---|---|---|---|
| | Solid uniformity | High-light area image quality | Transfer performance | Solid uniformity | High-light area image quality | Transfer performance |
| Example: | | | | | | |
| 9 | 0.01 | A | 98.9 | 0.02 | A | 98.7 |
| 10 | 0.01 | A | 98.7 | 0.02 | A | 98.6 |
| 11 | 0.01 | A | 98.9 | 0.03 | A | 98.7 |
| 12 | 0.02 | A | 98.8 | 0.03 | A | 98.6 |
| 13 | 0.02 | A | 98.6 | 0.03 | A | 98.1 |
| 14 | 0.02 | B | 98.4 | 0.04 | B | 97.9 |
| Comparative Example: | | | | | | |
| 3 | 0.05 | B | 97.4 | 0.12 | D | 89.4 |
| 4 | 0.03 | B | 98.3 | 0.07 | C | 97.3 |

What is claimed is:

1. A process for producing a toner, comprising the step of polymerizing a polymerizable monomer in the presence of (i) base particles containing at least a binder resin and a colorant and (ii) a polymerization initator, wherein;

said polymerization initator has in one molecule a hydrophilic moiety and a hydrophobic moiety and a reactive moiety between them, and the base particles are enlarged and/or surface modified upon polymerization of the polymerizable monomer.

2. The process according to claim 1, wherein the hydrophobic moiety of said polymerization initiator has at least one group selected from an aliphatic hydrocarbon group having 5 to 60 carbon atoms, an aromatic hydrocarbon group having 6 to 60 carbon atoms, a heterocyclic group and a polysiloxane residual group.

3. The process according to claim 1, wherein the hydrophilic moiety of said polymerization initiator has at least one group selected from a polysaccharide group, a hydroxyl group, a sulfuric ester group, a sulfate, a sulfonic acid group, a sulfonic acid group having a salt structure, a carboxyl group, a carboxylate, a phosphoric ester group, a phosphate, a heterocyclic group, a heterocyclic salt, an amino group and an ammonium salt.

4. The process according to claim 1, wherein the reactive moiety of said polymerization initiator has at least one group selected from an azo group, a peroxide group, a diketone group and a persulfuric acid group.

5. The process according to claim 1, wherein said polymerization initiator is a compound represented by the following Formula (1):

$$R^1—X—Z—Y—R^2 \quad (1)$$

wherein $R^1$ is a hydrophobic group, $R^2$ is a hydrophilic group, Z is a reactive group, and X and Y represent units which link with the groups represented by $R^1$ or $R^2$, respectively, and Z.

6. The process according to claim 5, wherein in Formula (1) the group represented by $R^1$ is at least one group selected from an aliphatic hydrocarbon group having 5 to 60 carbon atoms, an aromatic hydrocarbon group having 6 to 60 carbon atoms, a heterocyclic group and a polysiloxane residual group.

7. The process according to claim 5, wherein in Formula (1) the group represented by $R^2$ is a group selected from a polysaccharide group, a hydroxyl group, a sulfuric ester group, a sulfate, a sulfonic acid group, a sulfonic acid group having a salt structure, a carboxyl group, a carboxylate, a phosphoric ester group, a phosphate, a heterocyclic group, a heterocyclic salt, an amino group, an ammonium salt, and an aliphatic hydrocarbon group or aromatic hydrocarbon group having as a substituent at least one of these as a substituent.

8. The process according to claim 7, wherein said aromatic hydrocarbon group represented by $R^2$ has 1 to 20 carbon atoms.

9. The process according to claim 7, wherein said aromatic hydrocarbon group represented by $R^2$ has 6 to 20 carbon atoms.

10. The process according to claim 5, wherein, in Formula (1), the group represented by Z is an azo group, the units represented by X and Y are units which may be the same or different and each have at least one bond or linkage selected from a carbon carbon bond, an ester linkage, an amide linkage, an ether linkage, a urethane linkage and a urea linkage, and any one of the units X and Y has an electron attracting group.

11. The process according to any one of claims 5 to 10, wherein said compound represented by Formula (1) is a compound represented by the following Formula (2):

$$R^{1a}—A^1—R^3—N{=}N—R^4—A^2—R^{2a} \quad (2)$$

wherein $R^{1a}$ is an aliphatic hydrocarbon group having 6 to 30 carbon atoms, or an aryl group having 6 to 12 carbon atoms which has as a substituent an alkyl group having 1 to 20 carbon atoms; $R^{2a}$ is at least one group selected from a carboxyl group, a carboxylate, a sulfuric ester group, a sulfate, a sulfonic acid group, a sulfonic acid group having a salt structure, and an aliphatic or aromatic hydrocarbon group having at least one of these groups as a substituent; $R^3$ and $R^4$ may be the same or different and are alkylene groups having electron attracting groups on the carbon atoms adjoining to the azo group; $A^1$ may be absent, or represents at least one linkage selected from an ester linkage, an amide linkage, a urethane linkage and an ether linkage; and $A^2$ may be absent, or represents at least one linkage selected from an ester linkage, an amide linkage, a urethane linkage and an ether linkage.

12. The process according to claim 11, wherein, in said compound represented by Formula (2), $R^{1a}$ is a long chain aliphatic hydrocarbon group having 10 to 22 carbon atoms, or a phenyl group having as a substituent an alkyl group having 1 to 18 carbon atoms; $R^{2a}$ is at least one group selected from a carboxyl group, a carboxylate, a sulfuric ester group, a sulfate, a sulfonic acid group, a sulfonic acid group having a salt structure, and an aliphatic hydrocarbon or aromatic hydrocarbon group having at least one of these groups as a substituent; $R^3$ and $R^4$ may be the same or different and are alkylene groups having 2 to 6 carbon atoms and having cyano groups on the carbon atoms adjoining to the azo group; $A^1$ may be absent, or represents at least one linkage selected from an ester linkage and an amide linkage; and $A^2$ may be absent, or represents at least one linkage selected from an ester linkage and an amide linkage.

13. The process according to claim 11, wherein said aliphatic hydrocarbon represented by $R^{2a}$ has 1 to 20 carbon atoms.

14. The process according to claim 11, wherein said aromatic hydrocarbon represented by $R^{2a}$ has 6 to 20 carbon atoms.

15. The process according to claim 1, wherein said polymerizable monomer to be polymerized at said base particles is a radically polymerizable monomer.

16. The process according to claim 1, wherein a resin formed by polymerization of the polymerizable monomer to be polymerized at the base particles has a glass transition point, and the glass transition point is within the range of from 35° C. to 100° C.

17. The process according to claim 1, wherein said polymerization initiator is added in an amount within the range of from 0.01% by weight to 20% by weight based on the weight of said base particles.

18. The process according to claim 1, wherein the step of polymerizing the polymerizable monomer has the course of dispersing said base particles in an aqueous or hydrophilic medium by the use of the polymerization initiator and the polymerizable monomer is added to the resultant dispersion to effect polymerization.

19. The process according to claim 1, wherein said polymerization initiator is a compound selected from the group consisting of compounds represented by the following formulas (i) to (vi):

(i)

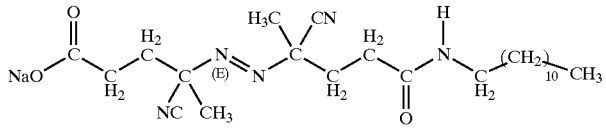

(ii)

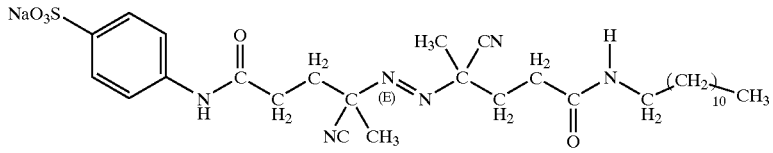

(iii)

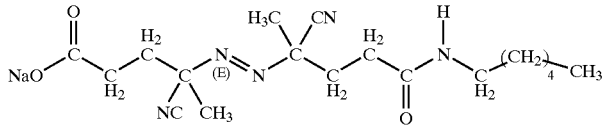

(iv)

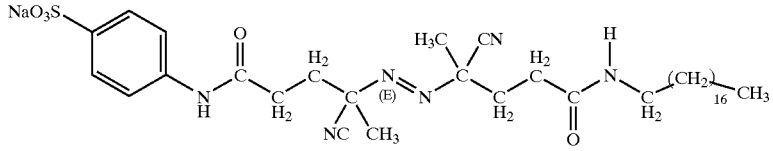

(v)

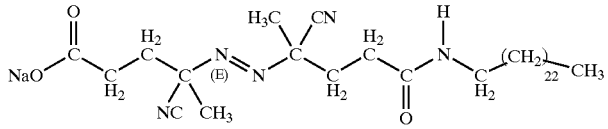

(vi)

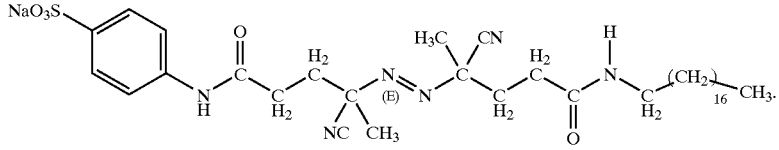

20. The process according to claim 1, which has, in the step of polymerizing the polymerizable monomer in the presence of said base particles, the course of heating the system to a temperature which is higher by 5° C. to 40° C. than the glass transition point of said base particles.

21. The process according to claim 1, wherein said base particles have an endothermic peak at 45° C. to 120° C. in their differential thermal analysis.

22. The process according to claim 1, wherein said base particles have a weight average particle diameter within the range of from 0.5 μm to 9 μm.

23. A toner comprising toner particles containing at least a binder resin and a colorant;

said toner particles having a circularity within the range of from 0.92 to 1.0; and said toner particles being toner particles obtained by polymerizing a polymerizable monomer in the presence of base particles containing at least a binder resin and a colorant, using a polymerization initiator having in one molecule a hydrophilic moiety and a hydrophobic moiety and a reactive moiety between them, to enlarge and/or surface modify the base particles.

24. The toner according to claim 23, wherein the hydrophobic moiety of said polymerization initiator has at least one group selected from an aliphatic hydrocarbon group having 5 to 60 carbon atoms, an aromatic hydrocarbon group having 6 to 60 carbon atoms, a heterocyclic group and a polysiloxane residual group.

25. The toner according to claim 23, wherein the hydrophilic moiety of said polymerization initiator has at least one group selected from a polysaccharide group, a hydroxyl group, a sulfuric ester group, a sulfate, a sulfonic acid group, a sulfonic acid group having a salt structure, a carboxyl group, a carboxylate, a phosphoric ester group, a phosphate, a heterocyclic group, a heterocyclic salt, an amino group and an ammonium salt.

26. The toner according to claim 23, wherein the reactive moiety of said polymerization initiator has at least one group selected from an azo group, a peroxide group, a diketone group and a persulfuric acid group.

27. The toner according to claim 23, wherein said polymerization initiator is a compound represented by the following Formula (1):

$$R^1—X—Z—Y—R^2 \quad (1)$$

wherein $R^1$ is a hydrophobic group, $R^2$ is a hydrophilic group, Z is a reactive group, and X and Y represent units which link with the groups represented by $R^1$ or $R^2$, respectively, and Z.

28. The toner according to claim 27, wherein in Formula (1) the group represented by $R^1$ is at least one group selected from an aliphatic hydrocarbon group having 5 to 60 carbon atoms, an aromatic hydrocarbon group having 6 to 60 carbon atoms, a heterocyclic group and a polysiloxane residual group.

29. The toner according to claim 27, wherein in Formula (1) the group represented by $R^2$ is a group selected from a polysaccharide group, a hydroxyl group, a sulfuric ester group, a sulfate, a sulfonic acid group, a sulfonic acid group having a salt structure, a carboxyl group, a carboxylate, a phoshporic ester group, a phosphate, a heterocyclic group, a heterocyclic salt, an amino group, an ammonium salt, and an aliphatic hydrocarbon group or aromatic hydrocarbon group having as a substituent at least one of these as a substituent.

30. The toner according to claim 29, wherein said aliphatic hydrocarbon group represented by $R^2$ has 1 to 20 carbon atoms.

31. The toner according to claim 29, wherein said aromatic hydrocarbon group represented by $R^2$ has 6 to 20 carbon atoms.

32. The toner according to claim 27, wherein, in Formula (1), the group represented by Z is an azo group, the units represented by X and Y are units which may be the same or different and each have at least one bond or linkage selected from a carbon carbon bond, an ester linkage, an amide linkage, an ether linkage, a urethane linkage and a urea linkage, and any one of the units X and Y has an electron attracting group.

33. The toner according to claim 27, wherein said compound represented by Formula (1) is a compound represented by the following Formula (2):

$$R^{1a}—A^1—R^3—N{=}N—R^4—A^2—R^{2a} \quad (2)$$

wherein $R^{1a}$ is an aliphatic hydrocarbon group having 6 to 30 carbon atoms, or an aryl group having 6 to 12 carbon atoms which has as a substituent an alkyl group having 1 to 20 carbon atoms; $R^{2a}$ is at least one group selected from a carboxyl group, a carboxylate, a sulfuric ester group, a sulfate, a sulfonic acid group, a sulfonic acid group having a salt structure, and an aliphatic or aromatic hydrocarbon group having at least one of these groups as a substituent; $R^3$ and $R^4$ may be the same or different and are alkylene groups having electron attracting groups on the carbon atoms adjoining to the azo group; $A^1$ may be absent, or represents at least one linkage selected from an ester linkage, an amide linkage, a urethane linkage and an ether linkage; and $A^2$ may be absent, or represents at least one linkage selected from an ester linkage, an amide linkage, a urethane linkage and an ether linkage.

34. The toner according to claim 33, wherein, in said compound represented by Formula (2), $R^{1a}$ is a long chain aliphatic hydrocarbon group having 10 to 22 carbon atoms, or a phenyl group having as a substituent an alkyl group having 1 to 18 carbon atoms; $R^{2a}$ is at least one group selected from a carboxyl group, a carboxylate, a sulfuric ester group, a sulfate, a sulfonic acid group, a sulfonic acid group having a salt structure, and an aliphatic hydrocarbon or aromatic hydrocarbon group having at least one of these groups as a substituent; $R^3$ and $R^4$ may be the same or different and are alkylene groups having 2 to 6 carbon atoms and having cyano groups on the carbon atoms adjoining to the azo group; $A^1$ may be absent, or represents at least one linkage selected from an ester linkage and an amide linkage; and $A^2$ may be absent, or represents at least one linkage selected from an ester linkage and an amide linkage.

35. The toner according to claim 33, wherein said aliphatic hydrocarbon represented by $R^{2a}$ has 1 to 20 carbon atoms.

36. The toner according to claim 33, wherein said aromatic hydrocarbon represented by $R^{2a}$ has 6 to 20 carbon atoms.

37. The toner according to claim 23, wherein said polymerizable monomer is a radically polymerizable monomer.

38. The toner according to claim 23, wherein a resin formed by polymerization of the polymerizable monomer has a glass transition point, and the glass transition point is within the range of from 35° C. to 100° C.

39. The toner according to claim 23, wherein said polymerization initiator is added in an amount within the range of from 0.01% by weight to 20% by weight based on the weight of said base particles.

40. The toner according to claim 23, wherein, when the polymerizable monomer is polymerized in the presence of said base particles, said base particles are dispersed in an aqueous or hydrophilic medium by the use of the polymerization initiator and the polymerizable monomer is added to the resultant dispersion to effect polymerization.

41. The toner according to claim 23, wherein, when said toner particles are obtained by polymerizing the polymerizable monomer, the system is heated to a temperature which is higher by 5° C. to 40° C. than the glass transition point of said base particles.

42. The toner according to claim 23, wherein said binder resin is chiefly composed of a styrene acrylate resin and/or a polyester resin.

43. The toner according to claim 23, wherein said base particles further have an endothermic peak at 45° C. to 120° C. in their differential thermal analysis.

44. The toner according to claim 23, wherein said toner particles constituting the toner have a core/shell structure in which cores are covered with shells distinguishable by the ruthenium tetraoxide and/or osmium tetraoxide dyeing method.

45. The toner according to claim 23, wherein said base particles have a weight average particle diameter within the range of from 0.5 μm to 9 μm.

46. The toner according to claim 23, wherein said polymerization initiator is a compound selected from the group consisting of compounds represented by the following formulas (i) to (vi):

(i)

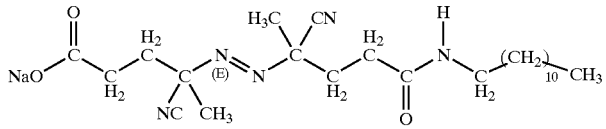

(ii)

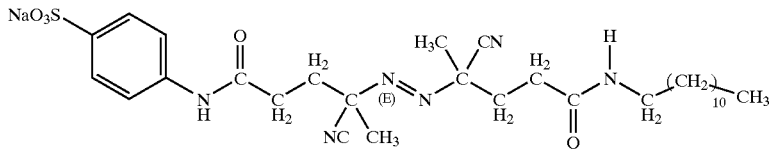

(iii)

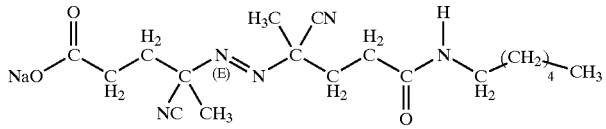

(iv)

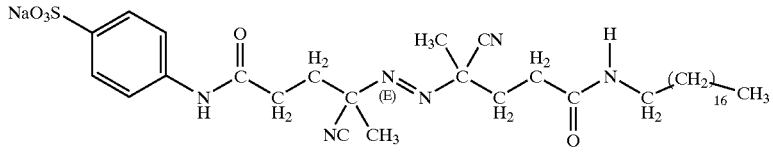

(v)

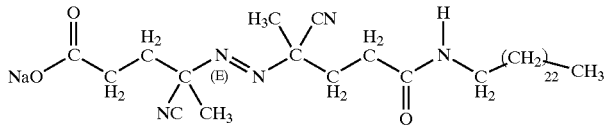

(vi)

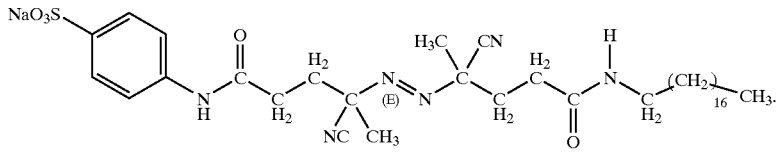

* * * * *

UNITED STATES PATENT AND TRADEMARK OFFICE

CERTIFICATE OF CORRECTION

PATENT NO. : 6,808,855 B2
DATED : October 26, 2004
INVENTOR(S) : Yasukazu Ayaki

It is certified that error appears in the above-identified patent and that said Letters Patent is hereby corrected as shown below:

Column 2,
Line 36, "be" should read -- is --; and
Line 38, "No" should read -- No. --.

Column 3,
Line 3, "come" should read -- comes --;
Line 4, "system" should read -- system, --; and
Lines 26 and 37, "found" should read -- been found --.

Column 7,
Line 5, "complicate" should read -- complicate. --.

Column 9,
Line 3, "—$C_xH_{2x}OC_yH_{2y+}$," should read -- —$C_xH_{2x}OC_yH_{2y+1}$, --; and
Line 15, "represent" should read -- represents --.

Column 10,
Line 62, "represent" should read -- represents --.

Column 12,
Line 9, "represents" should read -- represent --.

Column 17,
Line 21, "polym-" should read -- poly- --;
Line 22, "ethyl" should read -- methyl --;
Line 39, "dim-" should read -- di- --; and
Line 40, "ethylaminoethyl" should read -- methylaminoethyl --.

Column 19,
Line 28, "acton" should read -- action --.

Column 21,
Line 7, "derivativesr" should read -- derivatives --; and
Line 55, "measures." should read -- measured. --.

Column 22,
Line 1, "complicate" should read -- complicated --.

UNITED STATES PATENT AND TRADEMARK OFFICE

CERTIFICATE OF CORRECTION

PATENT NO. : 6,808,855 B2
DATED : October 26, 2004
INVENTOR(S) : Yasukazu Ayaki

It is certified that error appears in the above-identified patent and that said Letters Patent is hereby corrected as shown below:

Column 23,
Line 55,

" 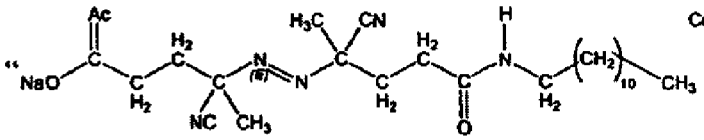

"

should read

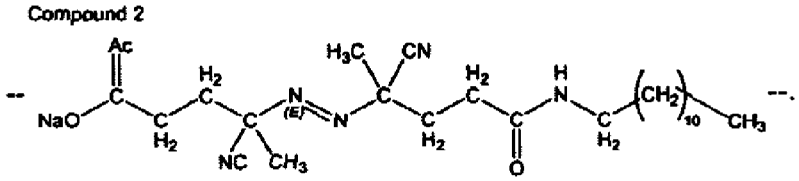

Column 32,
Line 54, "taps." should read -- tape. --.

Column 33,
Line 59, "initator, wherein;" should read -- initiator, wherein --; and
Line 60, "initator" should read -- initiator --.

Column 34,
Line 50, "carbon carbon" should read -- carbon-carbon --; and
Line 52, "electron" should read -- electron- --.

Column 35,
Line 2, "electron attracting" should read -- electron-attracting --; and
Line 9, "long chain" should read -- long-chain --.

UNITED STATES PATENT AND TRADEMARK OFFICE

CERTIFICATE OF CORRECTION

PATENT NO. : 6,808,855 B2 
DATED : October 26, 2004
INVENTOR(S) : Yasukazu Ayaki It is certified that error appears in the above-identified patent and that said Letters Patent is hereby corrected as shown below:

Column 36,
Line 27, "formulas" should read -- formulae --; and
Lines 30-65

"

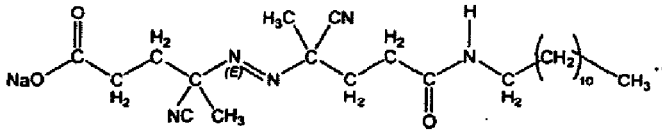

... (i)

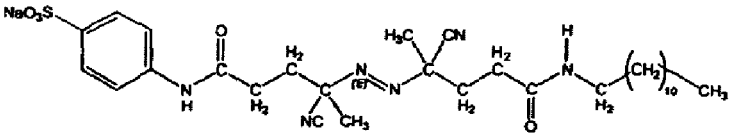

... (ii)

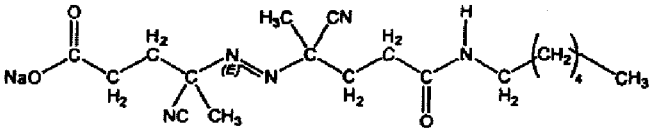

... (iii)

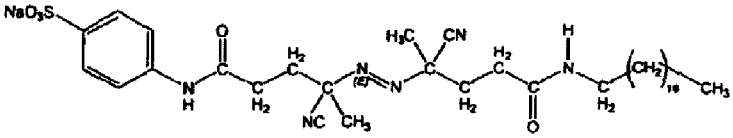

(iv)

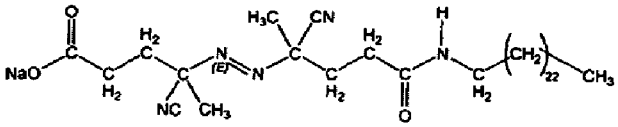

...(v)

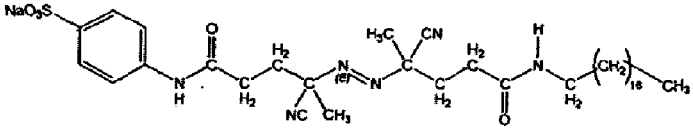

... (vi)"

UNITED STATES PATENT AND TRADEMARK OFFICE

CERTIFICATE OF CORRECTION

PATENT NO. : 6,808,855 B2
DATED : October 26, 2004
INVENTOR(S) : Yasukazu Ayaki

It is certified that error appears in the above-identified patent and that said Letters Patent is hereby corrected as shown below:

Column 36 (cont'd),
should read

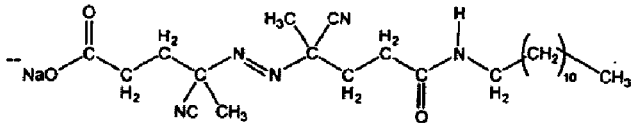

... (i)

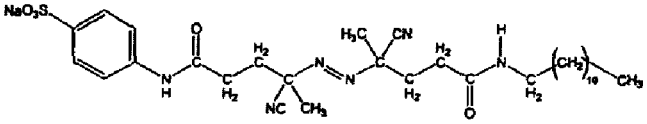

... (ii)

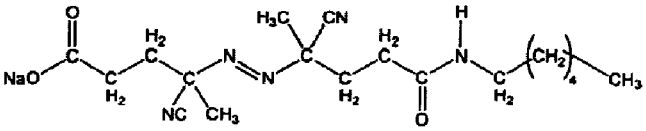

... (iii)

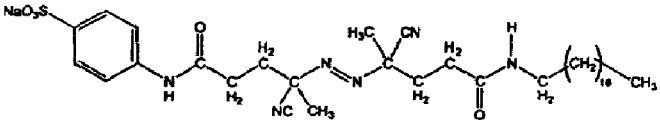

(iv)

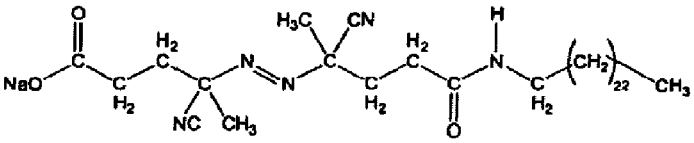

...(v)

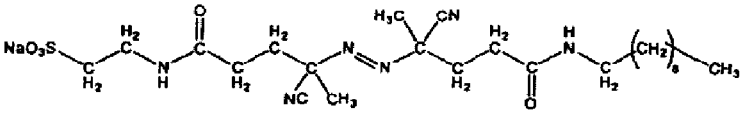

... (vi)--.

Column 37,
Line 30, "weight average" should read -- weight-average --; and
Line 66, "phoshporic" should read -- phosphoric --.

Column 38,
Line 16, "carbon carbon" should read -- carbon-carbon --;
Line 19, "electron" should read -- electron- --;
Line 38, "electron attracting" should read -- electron-attracting --; and
Line 47, "long chain" should read -- long-chain --.

UNITED STATES PATENT AND TRADEMARK OFFICE

CERTIFICATE OF CORRECTION

PATENT NO. : 6,808,855 B2 
DATED : October 26, 2004
INVENTOR(S) : Yasukazu Ayaki It is certified that error appears in the above-identified patent and that said Letters Patent is hereby corrected as shown below:

Column 40,
Line 4, "styrene acrylate" should read -- styrene-acrylate --;
Line 17, "weight average" should read -- weight-average --;
Line 22, "mulas" should read -- mulae --; and
Lines 30-65,

"

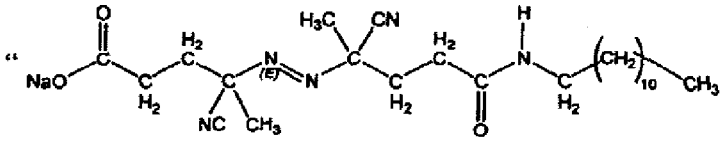

... (i)

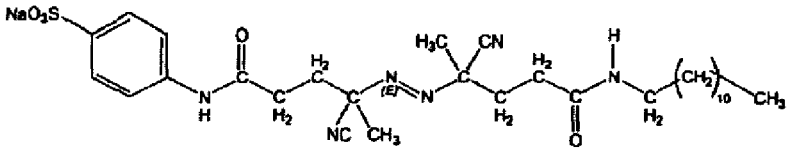

... (ii)

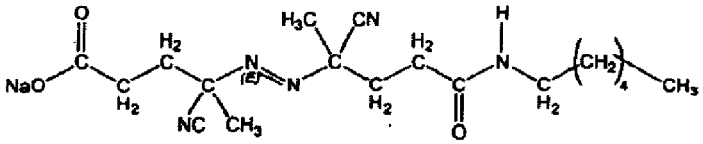

... (iii)

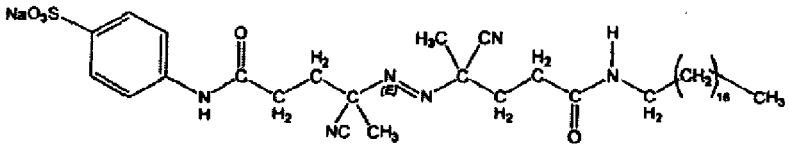

(iv)

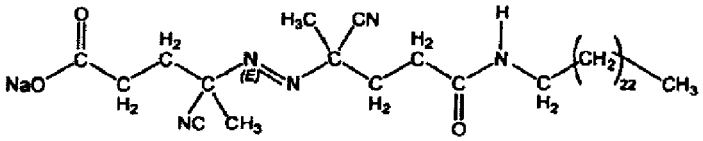

...(v)

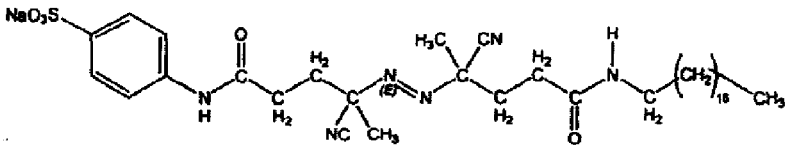

... (vi)"

UNITED STATES PATENT AND TRADEMARK OFFICE

CERTIFICATE OF CORRECTION

PATENT NO. : 6,808,855 B2 
DATED : October 26, 2004
INVENTOR(S) : Yasukazu Ayaki It is certified that error appears in the above-identified patent and that said Letters Patent is hereby corrected as shown below:

Column 40 (cont'd),
should read

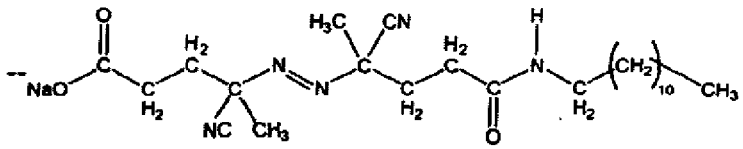

... (i)

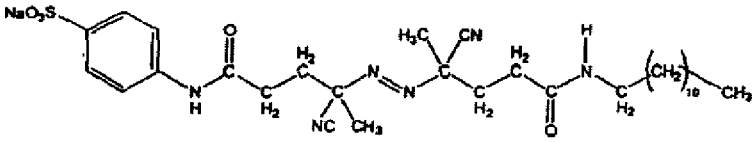

... (ii)

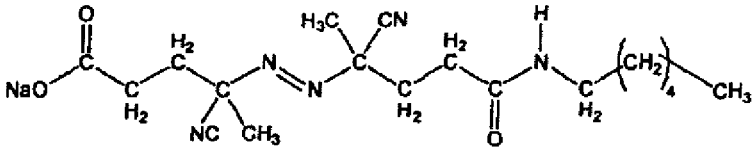

... (iii)

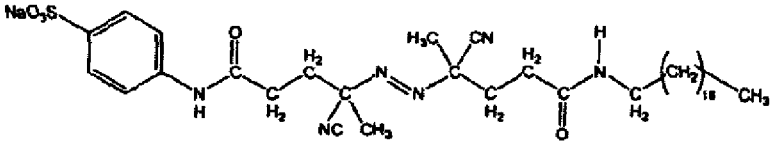

(iv)

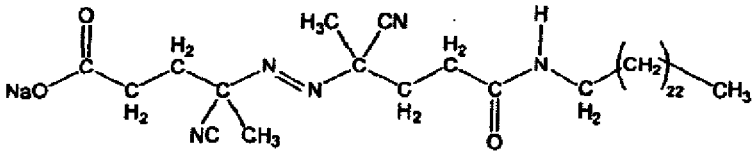

...(v)

UNITED STATES PATENT AND TRADEMARK OFFICE

CERTIFICATE OF CORRECTION

PATENT NO. : 6,808,855 B2
DATED : October 26, 2004
INVENTOR(S) : Yasukazu Ayaki

It is certified that error appears in the above-identified patent and that said Letters Patent is hereby corrected as shown below:

Column 40 (cont'd),

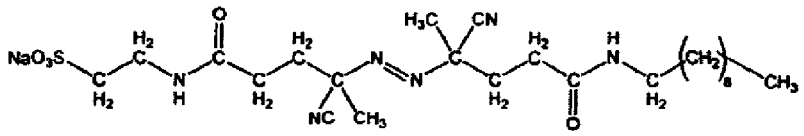

... (vi)--.

Signed and Sealed this

Twenty-fourth Day of May, 2005

JON W. DUDAS
*Director of the United States Patent and Trademark Office*